US012607009B2

(12) United States Patent
Pilz

(10) Patent No.: US 12,607,009 B2
(45) Date of Patent: Apr. 21, 2026

(54) FIRE-RATED GASKETS AND WALL ASSEMBLIES

(71) Applicant: CEMCO, LLC, City of Industry, CA (US)

(72) Inventor: Donald Anthony Pilz, Livermore, CA (US)

(73) Assignee: CEMCO, LLC, City of Industry, CA (US)

( * ) Notice: Subject to any disclaimer, the term of this patent is extended or adjusted under 35 U.S.C. 154(b) by 147 days.

(21) Appl. No.: 18/065,903

(22) Filed: Dec. 14, 2022

(65) Prior Publication Data

US 2023/0203807 A1 Jun. 29, 2023

Related U.S. Application Data

(60) Provisional application No. 63/266,039, filed on Dec. 27, 2021.

(51) Int. Cl.
*E04B 1/94* (2006.01)
*E04B 2/74* (2006.01)

(52) U.S. Cl.
CPC ..... *E04B 2/7411* (2013.01); *E04B 2/7457* (2013.01); *E04B 1/948* (2013.01)

(58) Field of Classification Search
CPC . E04B 1/94; E04B 1/941; E04B 1/943; E04B 1/942; E04B 1/948; E04B 1/947; E04B 2/7411; E04B 2/7457; B60J 10/24; B60J 10/246; B60J 10/248; B60J 10/27; B60J 10/273; B60J 10/34; B60J 10/35
See application file for complete search history.

(56) References Cited

U.S. PATENT DOCUMENTS

| | | | |
|---|---|---|---|
| 661,832 | A | 11/1900 | Wilkinson |
| 716,628 | A | 12/1902 | Dickey |
| 965,595 | A | 7/1910 | Nicholson |
| 1,130,722 | A | 3/1915 | Fletcher |
| 1,563,651 | A | 12/1925 | Pomerantz |
| 1,719,728 | A | 7/1929 | Saunders |
| 2,020,576 | A | 11/1935 | Runde |
| 2,105,771 | A | 1/1938 | Holdsworth |
| 2,114,386 | A | 4/1938 | Killion |
| 2,218,426 | A | 10/1940 | Hulbert, Jr. |
| 2,556,878 | A | 6/1951 | Kohlhaas |

(Continued)

FOREIGN PATENT DOCUMENTS

| | | |
|---|---|---|
| CA | 2234347 | 10/1999 |
| CA | 2498537 A1 | 8/2006 |

(Continued)

OTHER PUBLICATIONS

U.S. Appl. No. 17/303,173, filed May 21, 2021, Pilz et al.

(Continued)

*Primary Examiner* — Kyle J. Walraed-Sullivan
(74) *Attorney, Agent, or Firm* — VIA LLP

(57) ABSTRACT

A fire-blocking gasket includes a profile having a plurality of legs and defines an interior space. The interior space including a fire-blocking material and/or an intumescent material for providing fire, smoke and/or sound protection across a deflection gap in a building joint. The gasket can be installed within the building joint by direct attachment with a track member within the deflection gap.

24 Claims, 8 Drawing Sheets

(56) References Cited

U.S. PATENT DOCUMENTS 2,664,739 A 1/1954 Marcy
2,683,927 A 7/1954 Maronek
2,688,927 A 9/1954 Nuebling
2,733,786 A 2/1956 Drake
2,766,855 A 10/1956 Johnson et al.
2,994,114 A 8/1961 Black
3,041,682 A 7/1962 Alderfer et al.
3,129,792 A 4/1964 Gwynne
3,153,467 A 10/1964 Nelsson et al.
3,170,269 A 2/1965 Dunnington
3,197,119 A 7/1965 Hartig et al.
3,271,920 A 9/1966 Downing, Jr.
3,286,420 A 11/1966 Kenneth
3,305,993 A 2/1967 Nels
3,309,826 A 3/1967 Zinn
3,324,615 A 6/1967 Zinn
3,346,909 A 10/1967 Blackburn
3,355,852 A 12/1967 Lally
3,397,495 A 8/1968 Thompson
3,460,302 A 8/1969 Cooper
3,481,090 A 12/1969 Lizee
3,493,460 A 2/1970 Windecker
3,495,417 A 2/1970 Ratliff
3,537,219 A 11/1970 Navarre
3,562,985 A 2/1971 Nicosia
3,566,559 A 3/1971 Dickson
3,600,854 A 8/1971 Dallaire et al.
3,601,942 A 8/1971 Wilson
3,604,167 A 9/1971 Hays
3,609,933 A 10/1971 Jahn et al.
3,648,419 A 3/1972 Marks
3,668,041 A 6/1972 Lonning
3,683,569 A 8/1972 Holm
3,696,569 A 10/1972 Didry
3,707,819 A 1/1973 Calhoun et al.
3,713,263 A 1/1973 Mullen
3,730,477 A 5/1973 Wavrunek
3,744,199 A 7/1973 Navarre
3,757,480 A 9/1973 Young
3,786,604 A 1/1974 Kramer
3,837,126 A 9/1974 Voiturier et al.
3,839,839 A 10/1974 Tillisch et al.
3,866,370 A 2/1975 Guarino et al.
3,908,328 A 9/1975 Nelsson
3,921,346 A 11/1975 Sauer et al.
3,922,830 A 12/1975 Guarino et al.
3,934,066 A 1/1976 Murch
3,935,681 A 2/1976 Voiturier et al.
3,949,532 A 4/1976 Jonsson et al.
3,950,912 A 4/1976 Lundberg et al.
3,955,330 A 5/1976 Wendt
3,964,214 A 6/1976 Wendt
3,974,607 A 8/1976 Balinski
3,976,825 A 8/1976 Anderberg
3,998,027 A 12/1976 Wendt et al.
4,011,704 A 3/1977 O'Konski
4,017,090 A 4/1977 Cohen
4,034,526 A 7/1977 Deslaugiers
4,058,947 A 11/1977 Earle et al.
4,093,818 A 6/1978 Thwaites et al.
4,103,463 A 8/1978 Dixon
4,114,335 A 9/1978 Carroll
4,122,203 A 10/1978 Stahl
4,130,972 A 12/1978 Varlonga
4,139,664 A 2/1979 Wenrick
4,144,335 A 3/1979 Edwards
4,144,385 A 3/1979 Downing
4,152,878 A 5/1979 Balinski
4,164,107 A 8/1979 Kraemling et al.
4,176,503 A 12/1979 Ting
4,178,728 A 12/1979 Ortmanns et al.
4,197,687 A 4/1980 Benoit
4,203,264 A 5/1980 Kiefer et al.
4,205,498 A 6/1980 Unayama
4,217,731 A 8/1980 Saino
4,269,890 A 5/1981 Breitling et al.
4,276,332 A 6/1981 Castle
4,281,494 A 8/1981 Weinar
4,283,892 A 8/1981 Brown
4,295,304 A 10/1981 Kim
4,318,253 A 3/1982 Wedel
4,320,611 A 3/1982 Freeman
4,324,835 A 4/1982 Keen
4,329,820 A 5/1982 Wendt
4,356,672 A 11/1982 Beckman et al.
4,361,994 A 12/1982 Carver
4,419,535 A 12/1983 O'Hara
4,424,653 A 1/1984 Heinen
4,433,732 A 2/1984 Licht et al.
4,434,592 A 3/1984 Reneault et al.
4,437,274 A 3/1984 Slocum et al.
4,454,690 A 6/1984 Dixon
4,461,120 A 7/1984 Hemmerling
4,467,578 A 8/1984 Weinar
4,480,419 A 11/1984 Crites
4,495,238 A 1/1985 Adiletta
4,497,150 A 2/1985 Wendt et al.
4,507,901 A 4/1985 Carroll
4,509,559 A 4/1985 Cheetham et al.
4,517,782 A 5/1985 Shamszadeh
4,530,877 A 7/1985 Hadley
4,574,454 A 3/1986 Dyson
4,575,979 A 3/1986 Mariani
4,578,913 A 4/1986 Eich
4,598,516 A 7/1986 Groshong
4,622,791 A 11/1986 Cook et al.
4,622,794 A 11/1986 Geortner
4,632,865 A 12/1986 Tzur
4,649,089 A 3/1987 Thwaites
4,663,204 A 5/1987 Langham
4,672,785 A 6/1987 Salvo
4,709,517 A 12/1987 Mitchell et al.
4,711,183 A 12/1987 Handler et al.
4,723,385 A 2/1988 Kallstrom
4,756,945 A 7/1988 Gibb
4,761,927 A 8/1988 O'Keeffe et al.
4,787,767 A 11/1988 Wendt
4,788,802 A 12/1988 Wokas
4,798,035 A 1/1989 Mitchell et al.
4,805,364 A 2/1989 Smolik
4,810,986 A 3/1989 Leupold
4,822,659 A 4/1989 Anderson et al.
4,825,610 A 5/1989 Gasteiger
4,830,913 A 5/1989 Ortmans et al.
4,845,904 A 7/1989 Menchetti
4,847,140 A * 7/1989 Jaskowski ..... B32B 5/06 19/145.5
4,850,173 A 7/1989 Beyer et al.
4,850,385 A 7/1989 Harbeke
4,854,096 A 8/1989 Smolik
4,854,107 A 8/1989 Roberts
4,866,898 A 9/1989 LaRoche et al.
4,881,352 A 11/1989 Glockenstein
4,884,381 A 12/1989 Betti
4,885,884 A 12/1989 Schilger
4,897,976 A 2/1990 Williams et al.
4,899,510 A 2/1990 Propst
4,914,880 A 4/1990 Albertini
4,918,761 A 4/1990 Harbeke
4,930,276 A 6/1990 Bawa et al.
4,935,281 A 6/1990 Tolbert et al.
4,982,540 A 1/1991 Thompson
4,986,040 A 1/1991 Prewer et al.
4,987,719 A 1/1991 Goodson, Jr.
4,992,310 A 2/1991 Gelb et al.
5,010,702 A 4/1991 Daw et al.
5,058,342 A 10/1991 Crompton
5,067,676 A 11/1991 Belle
5,079,088 A 1/1992 McGroarty
5,090,170 A 2/1992 Propst
5,094,780 A 3/1992 von Bonin
5,098,778 A 3/1992 Minnick
5,103,589 A 4/1992 Crawford
5,105,594 A 4/1992 Kirchner

(56) References Cited

U.S. PATENT DOCUMENTS

| | | | |
|---|---|---|---|
| 5,111,579 | A | 5/1992 | Andersen |
| 5,125,203 | A | 6/1992 | Daw |
| 5,127,203 | A | 7/1992 | Paquette |
| 5,127,760 | A | 7/1992 | Brady |
| 5,140,792 | A | 8/1992 | Daw et al. |
| 5,146,723 | A | 9/1992 | Greenwood et al. |
| 5,152,113 | A | 10/1992 | Guddas |
| 5,155,957 | A | 10/1992 | Robertson et al. |
| 5,157,883 | A | 10/1992 | Meyer |
| 5,157,887 | A | 10/1992 | Watterworth, III |
| 5,167,876 | A | 12/1992 | Lem |
| 5,173,515 | A | 12/1992 | von Bonin et al. |
| 5,203,132 | A | 4/1993 | Smolik |
| 5,205,099 | A | 4/1993 | Grünhage et al. |
| 5,212,914 | A | 5/1993 | Martin et al. |
| 5,214,894 | A | 6/1993 | Glesser-Lott |
| 5,222,335 | A | 6/1993 | Petrecca |
| 5,228,254 | A | 7/1993 | Honeycutt, Jr. |
| 5,244,709 | A | 9/1993 | Vanderstukken |
| 5,279,087 | A | 1/1994 | Mann |
| 5,279,088 | A | 1/1994 | Heydon |
| 5,279,091 | A | 1/1994 | Williams et al. |
| 5,282,615 | A | 2/1994 | Green et al. |
| 5,285,615 | A | 2/1994 | Gilmour |
| 5,307,600 | A | 5/1994 | Simon et al. |
| 5,315,804 | A | 5/1994 | Attalla |
| 5,319,339 | A | 6/1994 | Leupold |
| 5,325,651 | A | 7/1994 | Meyer et al. |
| 5,339,577 | A | 8/1994 | Snyder |
| 5,347,780 | A | 9/1994 | Richards et al. |
| 5,367,850 | A | 11/1994 | Nicholas |
| 5,374,036 | A | 12/1994 | Rogers et al. |
| 5,376,429 | A | 12/1994 | McGroarty |
| 5,390,458 | A | 2/1995 | Menchetti |
| 5,390,465 | A | 2/1995 | Rajecki |
| 5,394,665 | A | 3/1995 | Johnson |
| 5,412,919 | A | 5/1995 | Pellock et al. |
| 5,433,991 | A | 7/1995 | Boyd, Jr. et al. |
| 5,452,551 | A | 9/1995 | Charland et al. |
| 5,454,203 | A | 10/1995 | Turner |
| 5,456,050 | A | 10/1995 | Ward |
| 5,460,864 | A | 10/1995 | Heitkamp |
| 5,471,791 | A | 12/1995 | Keller |
| 5,471,805 | A | 12/1995 | Becker |
| 5,475,961 | A | 12/1995 | Menchetti |
| 5,477,652 | A | 12/1995 | Torrey et al. |
| 5,481,834 | A | 1/1996 | Kowalczyk et al. |
| 5,502,937 | A | 4/1996 | Wilson |
| 5,505,031 | A | 4/1996 | Heydon |
| 5,531,051 | A | 7/1996 | Chenier, Jr. et al. |
| 5,552,185 | A | 9/1996 | De Keyser |
| 5,592,796 | A | 1/1997 | Landers |
| 5,604,024 | A | 2/1997 | von Bonin |
| 5,607,758 | A | 3/1997 | Schwartz |
| 5,644,877 | A | 7/1997 | Wood |
| 5,681,640 | A | 10/1997 | Kiser |
| 5,687,532 | A | 11/1997 | Torrey |
| 5,687,538 | A | 11/1997 | Frobosilo et al. |
| 5,689,922 | A | 11/1997 | Daudet |
| 5,694,726 | A | 12/1997 | Wu |
| 5,709,821 | A | 1/1998 | von Bonin et al. |
| 5,724,784 | A | 3/1998 | Menchetti |
| 5,735,100 | A | 4/1998 | Campbell |
| 5,740,635 | A | 4/1998 | Gil et al. |
| 5,740,643 | A | 4/1998 | Huntley |
| 5,755,066 | A | 5/1998 | Becker |
| 5,765,332 | A | 6/1998 | Landin et al. |
| 5,782,690 | A | 7/1998 | Gustafson et al. |
| 5,787,651 | A | 8/1998 | Horn et al. |
| 5,797,233 | A | 8/1998 | Hascall |
| 5,798,679 | A | 8/1998 | Pissanetzky |
| 5,806,261 | A | 9/1998 | Huebner et al. |
| 5,809,721 | A | 9/1998 | Antropius |
| 5,820,958 | A | 10/1998 | Swallow |
| 5,822,935 | A | 10/1998 | Mitchell et al. |
| 5,870,866 | A | 2/1999 | Herndon |
| 5,913,788 | A | 6/1999 | Herren |
| 5,921,041 | A | 7/1999 | Egri, II |
| 5,927,041 | A | 7/1999 | Sedlmeier et al. |
| 5,930,963 | A | 8/1999 | Nichols |
| 5,930,968 | A | 8/1999 | Pullman |
| 5,945,182 | A | 8/1999 | Fowler et al. |
| 5,950,385 | A | 9/1999 | Herren |
| 5,968,615 | A | 10/1999 | Schlappa |
| 5,968,669 | A | 10/1999 | Liu et al. |
| 5,970,672 | A | 10/1999 | Robinson |
| 5,974,750 | A | 11/1999 | Landin et al. |
| 5,974,753 | A | 11/1999 | Hsu |
| 6,023,898 | A | 2/2000 | Josey |
| 6,058,668 | A | 5/2000 | Herren |
| 6,061,985 | A | 5/2000 | Kraus et al. |
| 6,086,709 | A | 7/2000 | Hills |
| 6,110,559 | A | 8/2000 | De Keyser |
| 6,116,404 | A | 9/2000 | Heuft et al. |
| 6,119,411 | A | 9/2000 | Gil et al. |
| 6,125,608 | A | 10/2000 | Charlson |
| 6,128,874 | A | 10/2000 | Olson et al. |
| 6,128,877 | A | 10/2000 | Goodman et al. |
| 6,131,352 | A | 10/2000 | Barnes et al. |
| 6,151,858 | A | 11/2000 | Ruiz et al. |
| 6,153,668 | A | 11/2000 | Gestner et al. |
| 6,176,053 | B1 | 1/2001 | St. Germain |
| 6,182,407 | B1 | 2/2001 | Turpin et al. |
| 6,189,277 | B1 | 2/2001 | Boscamp |
| 6,207,077 | B1 | 3/2001 | Burnell-Jones |
| 6,207,085 | B1 | 3/2001 | Ackerman |
| 6,213,679 | B1 | 4/2001 | Frobosilo et al. |
| 6,216,404 | B1 | 4/2001 | Vellrath |
| 6,233,888 | B1 | 5/2001 | Wu |
| 6,256,948 | B1 | 7/2001 | Van Dreumel |
| 6,256,960 | B1 | 7/2001 | Babcock et al. |
| 6,256,980 | B1 | 7/2001 | Lecordix et al. |
| 6,279,289 | B1 | 8/2001 | Soder et al. |
| 6,305,133 | B1 | 10/2001 | Cornwall |
| 6,318,044 | B1 | 11/2001 | Campbell |
| 6,374,558 | B1 | 4/2002 | Surowiecki |
| 6,381,913 | B2 | 5/2002 | Herren |
| 6,393,774 | B1 | 5/2002 | Fisher |
| 6,405,502 | B1 | 6/2002 | Cornwall |
| 6,408,578 | B1 | 6/2002 | Tanaka et al. |
| 6,430,881 | B1 | 8/2002 | Daudet et al. |
| 6,470,638 | B1 | 10/2002 | Larson |
| 6,487,825 | B1 | 12/2002 | Silik |
| 6,536,169 | B2 | 3/2003 | Dykhoff |
| 6,574,930 | B2 | 6/2003 | Kiser |
| 6,595,383 | B2 | 7/2003 | Pietrantoni |
| 6,606,831 | B2 | 8/2003 | Degelsegger |
| 6,647,691 | B2 | 11/2003 | Becker et al. |
| 6,668,499 | B2 | 12/2003 | Degelsegger |
| 6,679,015 | B1 | 1/2004 | Cornwall |
| 6,688,056 | B2 | 2/2004 | von Hoyningen Huene et al. |
| 6,688,499 | B2 | 2/2004 | Zhang |
| 6,698,146 | B2 | 3/2004 | Morgan et al. |
| 6,705,047 | B2 | 3/2004 | Yulkowski |
| 6,708,627 | B1 | 3/2004 | Wood |
| 6,711,871 | B2 | 3/2004 | Beirise et al. |
| 6,732,481 | B2 | 5/2004 | Stahl, Sr. |
| 6,739,926 | B2 | 5/2004 | Riach et al. |
| 6,748,705 | B2 | 6/2004 | Orszulak |
| 6,783,345 | B2 | 8/2004 | Morgan et al. |
| 6,792,733 | B2 | 9/2004 | Wheeler et al. |
| 6,799,404 | B2 | 10/2004 | Spransy |
| 6,820,382 | B1 | 11/2004 | Chambers et al. |
| 6,843,035 | B1 | 1/2005 | Glynn |
| 6,854,237 | B2 | 2/2005 | Surowiecki |
| 6,871,470 | B1 | 3/2005 | Stover |
| 6,944,997 | B2 | 9/2005 | Verkamp |
| 6,951,162 | B1 | 10/2005 | Shockey et al. |
| 6,955,017 | B2 | 10/2005 | Hilburn |
| 6,996,944 | B2 | 2/2006 | Shaw |
| 7,043,880 | B2 | 5/2006 | Morgan et al. |
| 7,059,092 | B2 | 6/2006 | Harkins et al. |
| 7,104,024 | B1 | 9/2006 | deGirolamo et al. |
| 7,152,385 | B2 | 12/2006 | Morgan et al. |

(56) References Cited

U.S. PATENT DOCUMENTS

| | | | |
|---|---|---|---|
| 7,191,845 | B2 | 3/2007 | Loar |
| 7,240,905 | B1 | 7/2007 | Stahl |
| 7,251,918 | B2 | 8/2007 | Reif et al. |
| 7,284,355 | B2 | 10/2007 | Becker et al. |
| 7,302,776 | B2 | 12/2007 | Duncan et al. |
| 7,398,856 | B2 | 7/2008 | Foster et al. |
| 7,413,024 | B1 | 8/2008 | Simontacchi et al. |
| 7,441,565 | B2 | 10/2008 | Imamura et al. |
| 7,487,591 | B2 | 2/2009 | Harkins et al. |
| 7,497,056 | B2 | 3/2009 | Surowiecki |
| 7,506,478 | B2 | 3/2009 | Bobenhausen |
| 7,513,082 | B2 | 4/2009 | Johnson |
| 7,540,118 | B2 | 6/2009 | Jensen |
| 7,594,331 | B2 | 9/2009 | Andrews et al. |
| 7,603,823 | B2 | 10/2009 | Cann |
| 7,610,725 | B2 | 11/2009 | Willert |
| 7,617,643 | B2 | 11/2009 | Pilz et al. |
| 7,681,365 | B2 | 3/2010 | Klein |
| 7,685,792 | B2 | 3/2010 | Stahl, Sr. et al. |
| 7,716,891 | B2 | 5/2010 | Radford |
| 7,735,295 | B2 | 6/2010 | Surowiecki |
| 7,752,817 | B2 | 7/2010 | Pilz et al. |
| 7,770,348 | B2 | 8/2010 | Tollenaar |
| 7,775,006 | B2 | 8/2010 | Giannos |
| 7,776,170 | B2 | 8/2010 | Yu et al. |
| 7,797,893 | B2 | 9/2010 | Stahl, Sr. et al. |
| 7,810,295 | B2 | 10/2010 | Thompson |
| 7,814,718 | B2 | 10/2010 | Klein |
| 7,827,738 | B2 | 11/2010 | Abrams et al. |
| 7,836,652 | B2 | 11/2010 | Futterman |
| 7,866,108 | B2 | 1/2011 | Klein |
| 7,870,698 | B2 | 1/2011 | Tonyan et al. |
| 7,921,537 | B2 | 4/2011 | Rodlin |
| 7,921,614 | B2 | 4/2011 | Fortin et al. |
| 7,941,981 | B2 | 5/2011 | Shaw |
| 7,950,198 | B2 | 5/2011 | Pilz et al. |
| 7,966,778 | B2 | 6/2011 | Klein |
| 7,984,592 | B1 | 7/2011 | Jiras |
| 8,029,345 | B2 | 10/2011 | Messmer et al. |
| 8,056,293 | B2 | 11/2011 | Klein |
| 8,061,099 | B2 | 11/2011 | Andrews |
| 8,062,108 | B2 | 11/2011 | Carlson et al. |
| 8,069,625 | B2 | 12/2011 | Harkins et al. |
| 8,074,412 | B1 | 12/2011 | Gogan et al. |
| 8,074,416 | B2 | 12/2011 | Andrews |
| 8,079,188 | B2 | 12/2011 | Swartz et al. |
| 8,087,205 | B2 | 1/2012 | Pilz et al. |
| 8,096,084 | B2 | 1/2012 | Studebaker et al. |
| 8,100,164 | B2 | 1/2012 | Goodman et al. |
| 8,132,376 | B2 | 3/2012 | Pilz et al. |
| 8,136,314 | B2 | 3/2012 | Klein |
| 8,151,526 | B2 | 4/2012 | Klein |
| 8,181,404 | B2 | 5/2012 | Klein |
| 8,225,581 | B2 | 7/2012 | Strickland et al. |
| 8,281,552 | B2 | 10/2012 | Pilz et al. |
| 8,286,397 | B2 | 10/2012 | Shaw |
| 8,318,304 | B2 | 11/2012 | Valenziano |
| 8,322,094 | B2 | 12/2012 | Pilz et al. |
| 8,353,139 | B2 | 1/2013 | Pilz |
| 8,375,666 | B2 | 2/2013 | Stahl, Jr. et al. |
| 8,389,107 | B2 | 3/2013 | Riebel et al. |
| 8,413,394 | B2 | 4/2013 | Pilz et al. |
| 8,444,790 | B2 | 5/2013 | Tong |
| 8,453,413 | B2 | 6/2013 | Matiere |
| 8,468,759 | B2 | 6/2013 | Klein |
| 8,495,844 | B1 | 7/2013 | Johnson |
| 8,499,512 | B2 | 8/2013 | Pilz et al. |
| 8,539,732 | B2 | 9/2013 | Leahy |
| 8,541,084 | B2 | 9/2013 | Deiss et al. |
| 8,544,226 | B2 | 10/2013 | Rubel |
| 8,551,594 | B2 | 10/2013 | Deiss |
| 8,555,566 | B2 | 10/2013 | Pilz et al. |
| 8,578,672 | B2 | 11/2013 | Mattox et al. |
| 8,584,415 | B2 | 11/2013 | Stahl, Jr. et al. |
| 8,590,231 | B2 | 11/2013 | Pilz |
| 8,595,999 | B1 | 12/2013 | Pilz et al. |
| 8,596,019 | B2 | 12/2013 | Aitken |
| 8,601,760 | B2 | 12/2013 | Hilburn |
| 8,607,519 | B2 | 12/2013 | Hilburn |
| 8,640,415 | B2 | 2/2014 | Pilz et al. |
| 8,646,235 | B2 | 2/2014 | Hilburn, Jr. |
| 8,671,632 | B2 | 3/2014 | Pilz et al. |
| 8,695,301 | B2 | 4/2014 | Lutkajtis et al. |
| 8,728,608 | B2 | 5/2014 | Maisch |
| 8,782,977 | B2 | 7/2014 | Burgess |
| 8,793,946 | B2 | 8/2014 | Stahl et al. |
| 8,793,947 | B2 | 8/2014 | Pilz et al. |
| 8,826,599 | B2 | 9/2014 | Stahl |
| 8,871,326 | B2 | 10/2014 | Flennert |
| 8,938,922 | B2 | 1/2015 | Pilz et al. |
| 8,950,132 | B2 | 2/2015 | Collins et al. |
| 8,955,275 | B2 | 2/2015 | Stahl, Jr. |
| 8,973,319 | B2 | 3/2015 | Pilz et al. |
| 9,045,899 | B2 | 6/2015 | Pilz et al. |
| 9,127,454 | B2 | 9/2015 | Pilz et al. |
| 9,151,042 | B2 | 10/2015 | Simon et al. |
| 9,157,232 | B2 | 10/2015 | Stahl, Jr. |
| 9,163,444 | B1 | 10/2015 | Fontijn et al. |
| 9,206,596 | B1 | 12/2015 | Robinson |
| 9,284,730 | B2 | 3/2016 | Klein |
| 9,290,932 | B2 | 3/2016 | Pilz et al. |
| 9,290,934 | B2 | 3/2016 | Pilz et al. |
| 9,316,133 | B2 | 4/2016 | Schnitta |
| 9,371,644 | B2 | 6/2016 | Pilz et al. |
| 9,382,709 | B2 | 7/2016 | Collins et al. |
| 9,458,628 | B2 | 10/2016 | Pilz et al. |
| 9,481,998 | B2 | 11/2016 | Pilz et al. |
| 9,506,245 | B2 | 11/2016 | Mackintosh |
| 9,506,246 | B2 | 11/2016 | Joseph et al. |
| 9,512,614 | B2 | 12/2016 | Klein et al. |
| 9,523,193 | B2 | 12/2016 | Pilz |
| 9,551,148 | B2 | 1/2017 | Pilz |
| 9,616,259 | B2 | 4/2017 | Pilz et al. |
| 9,637,914 | B2 | 5/2017 | Pilz et al. |
| 9,677,268 | B2 | 6/2017 | Knight et al. |
| 9,683,364 | B2 | 6/2017 | Pilz et al. |
| 9,719,253 | B2 | 8/2017 | Stahl, Jr. et al. |
| 9,739,052 | B2 | 8/2017 | Pilz et al. |
| 9,739,054 | B2 | 8/2017 | Pilz et al. |
| 9,752,318 | B2 | 9/2017 | Pilz |
| 9,845,597 | B1 | 12/2017 | Shaw et al. |
| 9,879,421 | B2 | 1/2018 | Pilz |
| 9,883,607 | B2 | 1/2018 | Bernard |
| 9,885,178 | B1 | 2/2018 | Barnes et al. |
| 9,909,298 | B2 | 3/2018 | Pilz |
| 9,931,527 | B2 | 4/2018 | Pilz et al. |
| 9,995,039 | B2 | 6/2018 | Pilz et al. |
| 9,995,040 | B2 * | 6/2018 | Stahl, Jr. ..... E04B 2/825 |
| 10,000,923 | B2 | 6/2018 | Pilz |
| 10,010,805 | B2 | 7/2018 | Maxam et al. |
| 10,011,983 | B2 | 7/2018 | Pilz et al. |
| 10,036,155 | B2 | 7/2018 | Carless |
| 10,066,385 | B2 | 9/2018 | Foerg et al. |
| 10,077,550 | B2 | 9/2018 | Pilz |
| 10,100,514 | B2 | 10/2018 | Klein et al. |
| 10,166,418 | B2 | 1/2019 | Förg et al. |
| 10,174,499 | B1 | 1/2019 | Tinianov et al. |
| 10,184,246 | B2 | 1/2019 | Pilz et al. |
| 10,203,035 | B1 | 2/2019 | Robinson |
| 10,214,901 | B2 | 2/2019 | Pilz et al. |
| 10,220,226 | B2 | 3/2019 | Foerg |
| 10,227,775 | B2 | 3/2019 | Pilz et al. |
| 10,246,871 | B2 | 4/2019 | Pilz |
| 10,309,100 | B2 | 6/2019 | Long et al. |
| 10,323,409 | B1 | 6/2019 | Robinson |
| 10,323,411 | B2 | 6/2019 | Ackerman et al. |
| 10,406,389 | B2 | 9/2019 | Pilz et al. |
| 10,472,819 | B2 | 11/2019 | Klein et al. |
| 10,480,654 | B2 | 11/2019 | Robinson |
| 10,494,818 | B2 | 12/2019 | Maziarz |
| 10,519,652 | B2 | 12/2019 | Klein et al. |
| 10,538,915 | B1 | 1/2020 | Zemler et al. |
| 10,563,399 | B2 | 2/2020 | Pilz et al. |
| 10,619,347 | B2 | 4/2020 | Pilz et al. |

(56) References Cited

U.S. PATENT DOCUMENTS 10,626,598 B2 4/2020 Klein
10,669,710 B2 6/2020 Förg
10,689,842 B2 6/2020 Pilz
10,731,338 B1 8/2020 Zemler et al.
10,753,084 B2 8/2020 Pilz et al.
10,851,542 B2 12/2020 Hensley et al.
10,900,223 B2 1/2021 Pilz
10,914,065 B2 2/2021 Pilz
10,919,262 B2 2/2021 Zhu et al.
10,920,416 B2 2/2021 Klein et al.
10,954,670 B2 3/2021 Pilz
11,041,306 B2 6/2021 Pilz et al.
11,060,283 B2 7/2021 Pilz et al.
11,111,666 B2 9/2021 Pilz
11,118,346 B2 9/2021 Klein et al.
11,136,767 B2 10/2021 Foerg et al.
11,141,613 B2 10/2021 Pilz et al.
11,149,432 B2 10/2021 Gatland et al.
11,162,259 B2 11/2021 Pilz
11,230,839 B2 1/2022 Klein et al.
11,268,274 B2 3/2022 Pilz
11,280,084 B2 3/2022 Pilz
11,299,884 B2 4/2022 Stahl, Jr. et al.
11,313,121 B2 4/2022 Quirijns et al.
11,359,369 B2 6/2022 Sonney et al.
11,401,711 B2 8/2022 Klein
11,421,417 B2 8/2022 Pilz et al.
11,466,449 B2 10/2022 Pilz et al.
11,486,150 B2 11/2022 Stahl et al.
11,512,464 B2 11/2022 Klein
11,560,712 B2 1/2023 Pilz et al.
11,674,304 B2 6/2023 Landreth et al.
11,697,937 B2 7/2023 Campbell
11,713,572 B2 8/2023 Zemler et al.
11,732,465 B2 8/2023 Austin et al.
11,773,587 B2 10/2023 Pilz et al.
11,802,404 B2 10/2023 Pilz et al.
11,808,036 B2 11/2023 Klein et al.
11,866,932 B2 1/2024 Pilz et al.
11,873,636 B2 1/2024 Pilz et al.
11,891,800 B2 2/2024 Pilz
11,896,859 B2 2/2024 Pilz et al.
11,898,346 B2 2/2024 Pilz
11,905,705 B2 2/2024 Pilz et al.
11,920,343 B2 3/2024 Pilz
11,920,344 B2 3/2024 Pilz
11,933,042 B2 3/2024 Pilz
2002/0029535 A1 3/2002 Loper
2002/0095908 A1 7/2002 Kiser
2002/0160149 A1 10/2002 Garofalo
2002/0170249 A1 11/2002 Yulkowski
2003/0079425 A1 5/2003 Morgan et al.
2003/0089062 A1 5/2003 Morgan et al.
2003/0196401 A1 10/2003 Surowiecki
2003/0213211 A1 11/2003 Morgan et al.
2004/0010998 A1 1/2004 Turco
2004/0016191 A1 1/2004 Whitty
2004/0045234 A1 3/2004 Morgan et al.
2004/0139684 A1 7/2004 Menendez
2004/0149390 A1 8/2004 Monden et al.
2004/0157012 A1 8/2004 Miller et al.
2004/0211150 A1 10/2004 Bobenhausen
2005/0031843 A1 2/2005 Robinson et al.
2005/0034389 A1 2/2005 Boot et al.
2005/0183361 A1 8/2005 Frezza
2005/0246973 A1 11/2005 Jensen
2006/0032163 A1 2/2006 Korn
2006/0096200 A1 5/2006 Daudet
2006/0123723 A1 6/2006 Weir et al.
2006/0137293 A1 6/2006 Klein
2006/0213138 A1 9/2006 Milani et al.
2006/0261223 A1 11/2006 Orndorff, II et al.
2006/0277841 A1 12/2006 Majusiak
2007/0056245 A1 3/2007 Edmondson
2007/0068101 A1 3/2007 Weir et al.
2007/0125027 A1 6/2007 Klein
2007/0130873 A1 6/2007 Fisher
2007/0193202 A1 8/2007 Rice
2007/0261343 A1 11/2007 Stahl
2008/0053013 A1 3/2008 Tollenaar
2008/0087366 A1 4/2008 Yu et al.
2008/0134589 A1 6/2008 Abrams et al.
2008/0172967 A1 7/2008 Hilburn
2008/0196337 A1 8/2008 Surowiecki
2008/0250738 A1 10/2008 Howchin
2009/0090074 A1 4/2009 Klein
2009/0107064 A1 4/2009 Bowman
2009/0197060 A1 8/2009 Cho
2009/0223159 A1 9/2009 Colon
2009/0241465 A1 10/2009 Majors
2009/0260303 A1 10/2009 Jensen
2009/0282760 A1 11/2009 Sampson et al.
2009/0320392 A1 12/2009 Nowoczin et al.
2010/0115868 A1 5/2010 Shaw et al.
2010/0126092 A1 5/2010 Pilz et al.
2010/0170172 A1 7/2010 Klein
2010/0199583 A1 8/2010 Behrens et al.
2010/0266781 A1 10/2010 Kusinski et al.
2011/0011019 A1 1/2011 Stahl, Jr. et al.
2011/0016808 A1 1/2011 Hulburn, Jr.
2011/0041415 A1 2/2011 Esposito
2011/0056163 A1 3/2011 Kure
2011/0067328 A1 3/2011 Naccarato et al.
2011/0099928 A1 5/2011 Klein et al.
2011/0113709 A1 5/2011 Pilz et al.
2011/0123801 A1 5/2011 Valenciano
2011/0146180 A1 6/2011 Klein
2011/0167742 A1 7/2011 Klein
2011/0185656 A1 8/2011 Klein
2011/0214371 A1 9/2011 Klein
2011/0247281 A1 10/2011 Pilz et al.
2011/0262720 A1 10/2011 Riebel et al.
2011/0274886 A1 11/2011 Flennert
2011/0302857 A1 12/2011 McClellan et al.
2012/0023846 A1 2/2012 Mattox et al.
2012/0180414 A1 7/2012 Burgess
2012/0247038 A1 10/2012 Black
2012/0266550 A1 10/2012 Naccarato et al.
2012/0297710 A1 11/2012 Klein
2013/0031856 A1 2/2013 Pilz et al.
2013/0091790 A1* 4/2013 Stahl, Jr. ..... E04B 2/7411 52/232
2013/0118102 A1 5/2013 Pilz
2013/0118764 A1 5/2013 Porter
2013/0133844 A1 5/2013 Smart et al.
2013/0205694 A1 8/2013 Stahl, Jr.
2014/0219719 A1 8/2014 Hensley et al.
2014/0260017 A1 9/2014 Noble, III
2014/0345886 A1 11/2014 Yano et al.
2015/0086793 A1 3/2015 Kreysler et al.
2015/0135622 A1 5/2015 Muenzenberger et al.
2015/0135631 A1 5/2015 Förg
2015/0247319 A1* 9/2015 Pilz ..... E04B 2/7411 52/741.3
2015/0275506 A1 10/2015 Klein et al.
2015/0275507 A1 10/2015 Klein et al.
2015/0275510 A1 10/2015 Klein et al.
2015/0354210 A1 12/2015 Stahl, Jr. et al.
2015/0368898 A1* 12/2015 Stahl, Jr. ..... E04B 2/7409 277/647
2016/0016381 A1 1/2016 Celis et al.
2016/0017598 A1 1/2016 Klein et al.
2016/0017599 A1 1/2016 Klein et al.
2016/0097197 A1 4/2016 Pilz
2016/0130802 A1 5/2016 Pilz
2016/0201893 A1 7/2016 Ksiezppolski
2016/0208484 A1 7/2016 Pilz
2016/0265219 A1 9/2016 Pilz
2016/0296775 A1 10/2016 Pilz et al.
2016/0340586 A1 11/2016 Auth et al.
2016/0348357 A1 12/2016 Smith et al.
2017/0016227 A1 1/2017 Klein
2017/0175386 A1 6/2017 Pilz
2017/0198473 A1 7/2017 Pilz

(56) References Cited

U.S. PATENT DOCUMENTS

| | | | | |
|---|---|---|---|---|
| 2017/0232281 | A1 | 8/2017 | Rakic | |
| 2017/0234004 | A1 | 8/2017 | Pilz | |
| 2017/0234010 | A1 | 8/2017 | Klein | |
| 2017/0260741 | A1* | 9/2017 | Ackerman | A62C 2/065 |
| 2017/0306615 | A1 | 10/2017 | Klein et al. | |
| 2018/0010333 | A1 | 1/2018 | Förg | |
| 2018/0044913 | A1 | 2/2018 | Klein et al. | |
| 2018/0072922 | A1 | 3/2018 | Canale | |
| 2018/0171624 | A1 | 6/2018 | Klein et al. | |
| 2018/0171646 | A1 | 6/2018 | Stahl et al. | |
| 2018/0195282 | A1 | 7/2018 | Pilz | |
| 2018/0291619 | A1* | 10/2018 | Ackerman | E04B 1/948 |
| 2019/0284797 | A1 | 9/2019 | Pilz | |
| 2019/0284799 | A1 | 9/2019 | Förg | |
| 2019/0316350 | A1 | 10/2019 | Pilz et al. | |
| 2019/0323234 | A1 | 10/2019 | Watanabe et al. | |
| 2019/0323347 | A1 | 10/2019 | Hensley et al. | |
| 2019/0360195 | A1 | 11/2019 | Pilz et al. | |
| 2020/0056073 | A1 | 2/2020 | Hulteen et al. | |
| 2020/0080666 | A1 | 3/2020 | Rakic | |
| 2020/0199867 | A1* | 6/2020 | Ackerman | E04B 1/947 |
| 2020/0240140 | A1 | 7/2020 | Pilz | |
| 2020/0284030 | A1* | 9/2020 | Pilz | E04B 2/7411 |
| 2020/0308829 | A1 | 10/2020 | Hunsaker | |
| 2020/0340239 | A1 | 10/2020 | Chang | |
| 2020/0340242 | A1* | 10/2020 | Pilz | B32B 3/266 |
| 2020/0347590 | A1 | 11/2020 | Robinson | |
| 2020/0362551 | A1 | 11/2020 | Klein et al. | |
| 2021/0010257 | A1 | 1/2021 | Klein et al. | |
| 2021/0017761 | A1 | 1/2021 | Klein et al. | |
| 2021/0032927 | A1 | 2/2021 | Brown | |
| 2021/0040731 | A1 | 2/2021 | Pilz | |
| 2021/0062502 | A1 | 3/2021 | Archer et al. | |
| 2021/0101319 | A1 | 4/2021 | Klein et al. | |
| 2021/0148112 | A1 | 5/2021 | Klein | |
| 2021/0164222 | A1 | 6/2021 | Pilz | |
| 2021/0189721 | A1 | 6/2021 | Klein et al. | |
| 2021/0222422 | A1* | 7/2021 | Griffith | E04F 19/064 |
| 2021/0285208 | A1 | 9/2021 | Pilz | |
| 2021/0396004 | A1 | 12/2021 | Pilz | |
| 2022/0023684 | A1 | 1/2022 | Pilz et al. | |
| 2022/0042303 | A1 | 2/2022 | Pilz | |
| 2022/0056686 | A1 | 2/2022 | Pilz | |
| 2022/0098856 | A1 | 3/2022 | Pilz | |
| 2022/0106785 | A1 | 4/2022 | Klein | |
| 2022/0154456 | A1* | 5/2022 | Griffith | E04B 1/94 |
| 2022/0162851 | A1 | 5/2022 | Pilz | |
| 2022/0259852 | A1 | 8/2022 | Pilz | |
| 2022/0268017 | A1 | 8/2022 | Pilz | |
| 2022/0349177 | A1 | 11/2022 | Pilz | |
| 2022/0401767 | A1 | 12/2022 | Pilz | |
| 2023/0114420 | A1 | 4/2023 | Pilz et al. | |
| 2023/0115315 | A1 | 4/2023 | Pilz et al. | |
| 2023/0220665 | A1 | 7/2023 | Pilz et al. | |
| 2023/0407626 | A1 | 12/2023 | Pilz et al. | |
| 2024/0052629 | A1 | 2/2024 | Pilz et al. | |
| 2024/0125115 | A1 | 4/2024 | Pilz et al. | |
| 2024/0167269 | A1 | 5/2024 | Pilz et al. | |
| 2024/0175258 | A1 | 5/2024 | Pilz | |
| 2024/0189636 | A1 | 6/2024 | Pilz et al. | |
| 2024/0207661 | A1 | 6/2024 | Pilz et al. | |
| 2024/0209623 | A1 | 6/2024 | Pilz | |
| 2024/0218657 | A1 | 7/2024 | Pilz | |
| 2024/0240456 | A1 | 7/2024 | Pilz | |
| 2024/0263441 | A1 | 8/2024 | Pilz | |
| 2024/0263444 | A1 | 8/2024 | Pilz et al. | |

FOREIGN PATENT DOCUMENTS

| | | | |
|---|---|---|---|
| CA | 2711659 | | 2/2012 |
| CA | 2803439 | | 3/2017 |
| CN | 220201817 | | 12/2023 |
| DE | 2645807 | B1 | 3/1978 |
| DE | 60213279 | T2 | 7/2007 |
| EP | 0 335 347 | | 10/1989 |
| EP | 0 346 126 | | 12/1989 |
| EP | 0509701 | A1 | 10/1992 |
| EP | 2942193 | A1 | 11/2015 |
| EP | 3 196 376 | | 7/2017 |
| EP | 3 348 729 | | 7/2018 |
| EP | 3 556 957 | A1 | 10/2019 |
| EP | 3584381 | A1 | 12/2019 |
| GB | 2 159 051 | | 11/1985 |
| GB | 2 239 213 | A | 6/1991 |
| GB | 2 411 212 | | 8/2005 |
| GB | 2 424 658 | | 10/2006 |
| GB | 2 494 721 | A | 3/2013 |
| JP | H06-042090 | A | 2/1994 |
| JP | H06-146433 | | 5/1994 |
| JP | H06-220934 | | 8/1994 |
| JP | H07-004620 | U | 1/1995 |
| KR | 100664665 | B1 | 1/2007 |
| KR | 20190068167 | A | 6/2019 |
| WO | WO 2003/038206 | | 5/2003 |
| WO | WO 2004/071584 | | 8/2004 |
| WO | WO 2007/103331 | | 9/2007 |
| WO | WO 2013/113734 | | 8/2013 |
| WO | 2015121278 | | 8/2015 |
| WO | WO 2017/129398 | | 1/2017 |
| WO | WO 2019/108295 | | 6/2019 |

OTHER PUBLICATIONS

U.S. Appl. No. 18/150,111, filed Jan. 4, 2023, Pilz et al.

BlazeFrame 2009 catalog of products, available at least as of Mar. 4, 2010 from www.blazeframe.com, in 20 pages.

Catalog page from Stockton Products, printed from www.stocktonproducts.com, on Dec. 16, 2007, showing #5 Drip, in 1 page.

ClarkDietrich Building Systems, Product Submittal Sheet, (FTSC) Flat Trail Vertical Slide Clip. CD-FTSC11 Jul. 2011. 1 page.

Double TrackTM information sheets by Dietrich Metal Framing, in 2 pages; accessible on Internet Wayback Machine on Jul. 8, 2006.

FireStikTM by CEMCO Brochure, published on www.firestik.us, in 18 pages; accessible on Internet Wayback Machine on Aug. 13, 2007.

Information Disclosure Statement letter; U.S. Appl. No. 12/196,115, dated Aug. 4, 2011.

"Intumescent Expansion Joint Seals", Astroflame; http://www.astroflame.com/intumescent_expansion_joint_seals; Jul. 2011; 4 pages.

James A. Klein's Answer, Affirmative Defenses and Counterclaims to Third Amended Complaint; U.S. District Court, Central District of California; Case No. 2:12-cv-10791-DDP-MRWx; Filed Sep. 17, 2014; pp. 1-37.

Letter from Thomas E. Loop; counsel for defendant; Jun. 26, 2015.

Expert Report of James William Jones and exhibits; Case No. CV12-10791 DDP (MRWx); May 18, 15.

Letter from Ann G. Schoen of Frost Brown Todd, LLC; Jun. 24, 2015.

"System No. HW-D-0607", May 6, 2010, Metacaulk, www.rectorseal.com, www.metacaulk.com; 2008 Underwriters Laboratories Inc.; 2 pages.

Trim-Tex, Inc., TRIM-TEX Wall Mounted Deflection Bead Installation Instructions, 2 pages. [Undated. Applicant requests that the Examiner review and consider the reference as prior art for the purpose of examination.].

"Wall Mounted Deflection Bead," Trim-Tex Drywall Products; Oct. 9, 2016; 3 pages.

* cited by examiner

FIRE-RATED GASKETS AND WALL ASSEMBLIES

INCORPORATION BY REFERENCE

U.S. Pat. No. 10,689,842, issued Jun. 23, 2020, U.S. Pat. No. 10,753,084, issued Aug. 25, 2020, and provisional Application No. 63/266,039 filed on Dec. 27, 2021 are hereby incorporated by reference in their entireties.

BACKGROUND

Field

This disclosure generally relates to fire-rated building structures. In particular, the disclosure relates to fire-rated joint systems, wall assemblies, and other building structures that incorporate the fire-rated joint systems.

Description of Related Art

Fire-rated construction components and assemblies are commonly used in the construction industry. These components and assemblies are aimed at inhibiting or preventing fire, heat, or smoke from leaving one room or other portion of a building and entering another room or portion of a building. The fire, heat or smoke usually moves between rooms through vents, joints in walls, or other openings. The fire-rated components often incorporate fire-retardant materials which substantially block the path of the fire, heat, or smoke for at least some period of time. Intumescent materials work well for this purpose because they swell and char when exposed to flames helping to create a barrier to the fire, heat, and/or smoke.

Some particular wall joints with a high potential for allowing fire, heat, or smoke to pass from one room to another is the joint between a wall and an adjacent structure, which can be a ceiling, a floor, or another wall. A joint between the top of a wall and the ceiling can be referred to as a head-of-wall joint. A joint between the bottom of a wall and the floor can be referred to as a foot-of-wall joint. A joint between the side of a wall and another structure can be referred to as a side-of-wall joint. In modern multi-story or multi-level buildings, the head-of-wall joint and/or the side-of-wall joint is often a dynamic joint in which relative movement between the ceiling and the wall or between the two walls is permitted. This relative movement is configured to accommodate deflection in the building due to loading of the building or seismic forces. A wall assembly commonly includes a header track, bottom track, a plurality of wall studs and a plurality of wall board members, possibly among other components. A typical header track resembles a generally U-shaped (or some other similarly shaped) elongated channel capable of receiving or covering the ends of wall studs and holding the wall studs in place. The header track also permits the wall assembly to be coupled to an upper horizontal support structure, such as a ceiling or floor of a higher-level floor of a multi-level building.

Header tracks generally have a web and a pair of flanges, which extend in the same direction from opposing edges of the web. The header track can be a slotted header track, which includes a plurality of slots spaced along the length of the track and extending in a vertical direction. When the wall studs are placed into the slotted track, each of the plurality of slots aligned with a wall stud accommodates a fastener used to connect the wall stud to the slotted track. The slots allow the wall studs to move generally orthogonally relative to the track, creating a variable deflection gap between the wall board and the upper horizontal support structure. In those areas of the world where earthquakes are common, movement of the wall studs is important. If the wall studs are rigidly attached to the slotted track and not allowed to move freely in at least one direction, the stability of the wall and the building might be compromised. With the plurality of slots, the wall studs are free to move. Even in locations in which earthquakes are not common, movement between the studs and the header track can be desirable to accommodate movement of the building structure due to other loads, such as stationary or moving overhead loads.

The conventional method for creating a fire-rated head-of-wall joint is to stuff a fire-resistant mineral wool material into the head-of-wall joint and then spray an elastomeric material over the joint to retain the mineral wool in place. This conventional construction of a fire-rated head-of-wall joint is time-consuming, expensive and has other disadvantages.

SUMMARY

One aspect of the present disclosure involves a fire-rated head-of-wall assembly that allows dynamic movement and includes a header track coupled with an upper surface. The header track has a web and first and second flanges extending from the web in the same direction away from the upper surface. Each of the first and second flanges is substantially planar such that the track defines a substantially U-shaped cross section. A stud is coupled with the header track. An upper end of the stud is located between the first and second flanges. A wall board is coupled with the stud. A deflection gap is formed between an upper end of the wall board and the upper surface. The deflection gap is variable between a closed position and an open position relative to one another. A gasket for fire-blocking the deflection gap which includes a profile having an inner leg, an outer leg, and an upper leg connecting the inner leg and the outer leg. A lower leg is connected with the outer leg. An interior is at least partially enclosed by the inner leg, the outer leg, the upper leg, and the lower leg. An upper gasket extending from the upper leg. A fire-blocking material strip is disposed within the interior of the profile. The inner leg is coupled with the first flange of the header track. The upper gasket contacts the upper surface. The wall board at least partially overlaps the outer leg in the open position and the closed position of the deflection gap.

In some configurations, a first end of the gasket further includes a tab member configured to overlap a second gasket.

In some configurations, the outer wall comprises the tab member, the tab member extending past ends of the upper gasket, the upper leg, the inner leg, and the lower leg.

In some configurations, the tab member has a length of at least ½ inch.

In some configurations, the profile includes a vinyl material.

In some configurations, upper gasket is formed integrally with the upper leg of a first material.

In some configurations, the profile includes a first material, the upper gasket includes a second, different material, and the upper gasket is co-extruded with the profile.

In some configurations, the upper gasket is a bubble gasket.

In some configurations, the upper gasket is a flexible fin.

In some configurations, the upper gasket includes a foam material.

In some configurations, a return leg is connected with the inner leg of the gasket, the return leg extending into the interior and contacting the fire-blocking material strip to inhibit sliding of the fire-blocking material strip within the interior.

In some configurations, the fire-rated head-of-wall assembly includes an adhesive within the interior to inhibit sliding of the fire-blocking material strip within the interior.

In some configurations, the fire rated head-of-wall assembly further includes a double-sided tape attaching the gasket with the header track, the double-sided tape having a first face attached with the inner leg and a second face attached with the first flange.

In some configurations, the fire rated head-of-wall assembly further includes an opening into the interior extending between the inner leg and the lower leg of the gasket wherein at least a portion of the fire-blocking material strip aligns with the opening and the opening is at least partially aligned with the first flange of the header track.

In some configurations, the fire-blocking material strip comprises an intumescent material.

In some configurations, the fire-blocking material strip comprises a mineral wool.

In some configurations, the fire-blocking material strip comprises at least one layer of mineral wool and at least one layer of graphite.

In some configurations, the lower leg includes a free end having a hook shape extending inwardly from the outer leg, the hook shape configured to allow the lower leg to pass over a mechanical fastener attaching the header track with the stud, and the free end of the lower leg contacting the first flange.

In some configurations, the lower leg includes a rounded lower end portion having a free end, wherein the free end of the rounded lower end portion is configured to be spaced outwardly from the first flange of the header track to allow the lower end portion to pass over a mechanical fastener attaching the header track with the stud.

In another aspect of the present disclosure, a gasket for fire-blocking a dynamic deflection gap includes a profile having an inner leg, an outer leg, an upper leg connecting the inner leg and the outer leg, and a lower leg connected with the outer leg. An interior is at least partially enclosed by the inner leg, the outer leg, the upper leg, and the lower leg. An upper gasket extends from the upper leg. A fire-blocking material strip is disposed within the interior of the profile.

In some configurations, the inner leg connects with the upper leg at a right angle and the outer leg connects with the upper leg at a right angle to form a U-shape.

In some configurations, a first end of the gasket further comprises a tab member configured to overlap a second gasket.

In some configurations, outer wall comprises the tab member, the tab member extending past ends of the upper gasket, the upper leg, the inner leg, and the lower leg.

In some configurations, the tab member has a length of at least ½ inch.

In some configurations, the profile includes a vinyl material.

In some configurations, upper gasket is formed integrally with the upper leg of a first material.

In some configurations, the profile includes a first material, the upper gasket includes a second, different material, and the upper gasket is co-extruded with the profile.

In some configurations, the upper gasket is a bubble gasket.

In some configurations, the upper gasket is a flexible fin.

In some configurations, the upper gasket includes a foam material.

In some configurations, a return leg is connected with the inner leg of the gasket, the return leg extending into the interior and contacting the fire-blocking material strip to inhibit sliding of the fire-blocking material strip within the interior.

In some configurations, the gasket for fire-blocking a dynamic deflection gap includes an adhesive within the interior to inhibit sliding of the fire-blocking material strip within the interior.

In some configurations, the gasket for fire-blocking a dynamic deflection gap further includes a double-sided tape attached with the inner leg.

In some configurations, the gasket for fire-blocking a dynamic deflection gap includes an opening into the interior extending between the inner leg and the lower leg of the gasket and wherein at least a portion of the fire-blocking material strip aligns with the opening.

In some configurations, the fire-blocking material strip includes an intumescent material.

In some configurations, the fire-blocking material strip includes a mineral wool.

In some configurations, the fire-blocking material strip includes at least one layer of mineral wool and at least one layer of graphite.

In some configurations, the lower leg includes a free end having a hook shape extending inwardly from the outer leg.

BRIEF DESCRIPTION OF THE DRAWINGS

Various examples are depicted in the accompanying drawings for illustrative purposes, and should in no way be interpreted as limiting the scope of the examples. For example, although the fire-blocking gasket is illustrated at a head-of-wall joint, the fire-blocking gasket can be utilized in other wall gaps (e.g., side or foot-of-wall gaps) or other construction gaps. Various features of different disclosed examples can be combined to form additional examples, which are part of this disclosure.

DETAILED DESCRIPTION

The various features and advantages of the systems, devices, and methods of the technology described herein will become more fully apparent from the following description of the examples illustrated in the figures. These examples are intended to illustrate the principles of this disclosure, and this disclosure should not be limited to merely the illustrated examples. The features of the illustrated examples can be modified, combined, removed, and/or substituted as will be apparent to those of ordinary skill in the art upon consideration of the principles disclosed herein.

The following disclosure provides an elongate, fire-rated joint component or fire-blocking gasket profile or profile, which is configured to provide fire protection and pass the relevant UL fire rating tests, or other relevant fire rating tests or standards. The multi-layer fire-rated joint component may be installed in a deflection gap of a wall assembly that allows dynamic movement according to the requirements of UL-2079.

Figure 1:
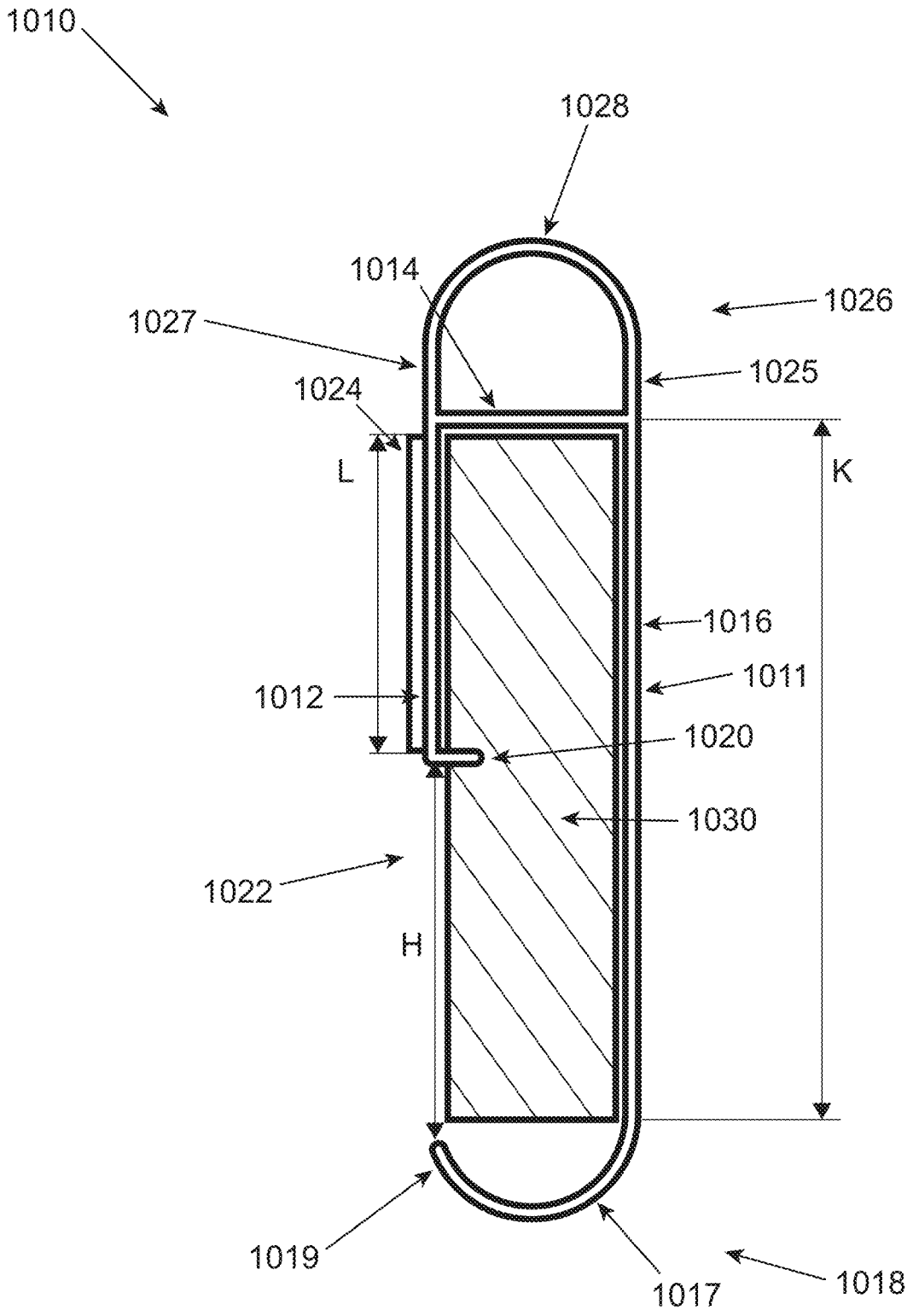
FIG. 1 illustrates a fire-blocking gasket including a fire-blocking material within an interior of a casing or profile.

With reference to FIG. 1, a fire-blocking gasket 1010 is shown in cross section. The fire-blocking gasket 1010 can be manufactured as elongate strips having the cross section as shown and described herein. Each of the elongate strips can have a uniform cross-sectional profile from end-to-end (exclusive of the tabs shown and discussed in relation to FIGS. 5 and 6, below). The gasket 1010 can be manufactured in various lengths such as 4, 5, 8, 10, or 12 feet, for example, or other lengths within a range between any two of these lengths. The length of the gasket 1010 can be trimmed to fit for use within a fire-rated joint. In some configurations, the fire-blocking gasket 1010 can have an overall height between about ¾ and 4 inches, or about 1 and 4 inches. In some configurations, the fire-blocking gasket 1010 can have an overall width between about ⅛ and ½ inches. As illustrated, the gasket 1010 can have an overall height of about 1.5 inches and an overall width of about ¼ inch.

The gasket 1010 can include a casing, which is referred to herein as a profile 1011. The casing or profile 1011 can form a portion or an entirety of an outer surface of the gasket 1010. The casing or profile 1011 can at least partially surround internal component(s) or feature(s) of the gasket 1010, as described below. In some configurations, the profile 1011 can completely surround internal component(s) of the gasket 1010. The profile 1011 can comprise a first material. The first material can be a metal, vinyl or other polymer material. The profile 1011 can include a plurality of legs or segments. Each of the legs can comprise one or multiple planar or curved portions. The profile 1011 can include an inner leg 1012, an upper leg 1014, an outer leg 1016 and/or lower leg 1018. The legs are identified by a location of the legs as illustrated in the accompanying figures for the sake of convenience. However, such description is not limiting and could be replaced with first leg, second leg, etc. In other configurations or implementations, the orientation of the gasket 1010 may vary.

The inner leg 1012 can comprise a flat planar portion. The inner leg 1012 can be aligned generally vertically. The inner leg 1012 can be connected with the upper leg 1014 at a corner.

The upper leg 1014 can comprise a flat planar portion. The upper leg 1014 can form a right angle with the inner leg 1012. The upper leg 1014 can be aligned generally horizontally. The outer leg 1016 can comprise a flat planar portion. The outer leg 1016 can be aligned generally vertically. The upper leg 1014 can connect with the outer leg 1016 at a corner.

The upper leg 1014 can be at a right angle with the outer leg 1016. The outer leg 1016 can be aligned generally vertically. The outer leg 1016 can be parallel with the inner leg 1012. Together the inner leg 1012, the upper leg 1014, and the outer leg 1016 can generally form a U-shape or an L-shape. In the illustrated arrangement, the outer leg 1016 has a greater length than the inner leg 1012.

The outer leg 1016 can be connected at a top end with the upper leg 1014 and at a bottom end with the lower leg 1018. The lower leg 1018 can connect at a corner or juncture with the lower end of the outer leg 1016. The lower leg 1018 can comprise free end 1019 and lower round leg 1017. The lower leg 1018 can extend generally orthogonally with respect to the outer leg 1016 in a direction towards the inner leg 1012. The lower leg 1018 can extend to a free end 1019. The lower leg 1018 can include an outwardly curved radius or be hook-shaped, such as lower round leg 1017. The curved radius can extend downwardly relative to the outer leg 1016, as shown in the orientation in FIG. 1. The material of the profile 1011 or a portion thereof can be generally flexible. The material of the profile 1011 or a portion thereof can enable the lower leg 1018 to elastically flex relative to the outer leg 1016. In some configurations, the lower leg 1018 can be constructed of the same material type as the outer leg 1016 but can be constructed to have a greater flexibility or reduced stiffness than the outer leg 1016 or another portion of the gasket 1010. For example, the lower leg 1018 can have one or more characteristics (e.g., density, thickness, hardness) that provide or contribute to the greater flexibility or reduced stiffness.

The profile 1011 can include or define an interior space. The legs of the profile 1011 can be oriented to form a generally rectangular shape about the interior space. The interior space can be at least partially or fully enclosed by the legs of the profile 1011. The interior space can be enclosed or partially enclosed by the inner leg 1012, upper leg 1014, outer leg 1016, and/or lower leg 1018.

The profile 1011 can include an opening 1022 into the interior space. The opening 1022 can extend generally between the lower leg 1018, such as at the free end 1019, and the inner leg 1012. The opening can be generally vertical in orientation. The opening can have a height H. The height H can be less than a height K of the outer leg 1016. The height H can be greater than or equal to a length L of the inner leg 1012. Alternatively, the height H can be less than the length L of the inner leg 1012. The length L of the inner leg 1012 can be equal to or less than the height K of the outer leg 1016. In one implementation, the height of the inner leg 1012 is less than one-half the height K of the outer leg 1016.

The profile 1011 can include or be connected with an upper gasket 1026. The upper gasket 1026 can be a hollow bubble gasket. In some embodiments, the upper gasket 1026 can form an interior space surrounded by side walls 1025 and 1027, upper leg 1014, and upper round leg 1028. The upper gasket 1026 can be made out of the same material as the profile 1011 or a different material than the profile 1011. If of the same material, the upper gasket 1026 can be extruded as a unitary component of the profile 1011. If of a different material, the upper gasket 1026 can be co-extruded with the profile 1011 or otherwise attached (e.g., adhesively). The material the upper gasket 1026 can comprise: rubber, silicone, foam or other materials. In one implementation, the upper gasket 1026 can comprise an open or closed cell foam block. In another implementation, the upper gasket can be formed out of a vinyl. In some implementations, the upper gasket 1026 can be constructed to have a greater flexibility or reduced stiffness than the inner leg 1012, the outer leg 1016 or another portion of the gasket 1010. For example, the upper gasket 1026 can have one or more characteristics (e.g., density, thickness, hardness) that provide or contribute to the greater flexibility or reduced stiffness. In some configurations, the upper gasket 1026 and the lower leg 1018 can be configured the same as one another. In other configurations, the upper gasket 1026 and the lower leg 1018 can be configured differently from one another. In some configurations, the upper leg 1014 can be omitted. In some such configurations, the upper gasket 1026 can form the upper leg 1014 of the gasket 1010.

The inner leg 1012 can include a return leg 1020. The return leg 1020 can extend inwardly into the interior space of the profile 1011 from any of the legs about the interior space. The return leg 1020 can be an L-shaped hook on the end of the inner leg 1012. The return leg 1020 can be located at the opening 1022. The return leg 1020 can bound one end of the opening 1022. In other implementations, the return leg 1020 or an additional return leg can extend from any of the other legs of the profile 1011, such as at the free end 1019 of the lower leg 1018. The return leg 1020 can include one or more serrations or other grip-enhancement features.

The inner leg 1012 can include an attachment device. The attachment device can be a tape 1024. One surface of the tape 1024 can be attached with an outer surface of the inner leg 1012. The one surface of the double-sided tape can be factory installed to the inner leg 1012. A second surface of the tape 1024 can face outwardly relative to the outer surface of the inner leg 1012. The second surface of the tape can include a removable paper or plastic member to protect the adhesive. The tape 1024 can be a foam tape. The tape 1024 can be a double-sided tape.

The fire-blocking gasket 1010 can include a fire-blocking material 1030. The fire-blocking material can comprise a mineral wool and/or intumescent material. In some implementations, the fire-blocking material 1030 can include an intumescent tape including an adhesive strip along one face thereof. In certain implementations, the fire-blocking material 1030 can comprise a composite of one or more alternating layers of mineral, wool, and graphite, such as the TENMANT fire-blocking materials manufactured by Tenmat Inc. USA.

The fire-blocking material 1030 can be sized to fit within the interior space of the profile 1011. The fire-blocking material 1030 can have a generally rectangular cross section, as shown in FIG. 1. An upper end of the fire-blocking material can abut the upper leg 1014. The lower end of the fire-blocking material 1030 can be adjacent to the lower leg 1018. The fire-blocking material 1030 can have a height that is less than the height of the profile between the upper leg 1014 and the lower leg 1018. In some configurations, the lower end of the fire-blocking material 1030 can be spaced from the lower leg 1018. In certain implementations, the height of the fire-blocking material 1030 can be sized such that the lower leg 1018 can at least partially provide a compression or retentive force on the fire-blocking material 1030 within the interior space. In some such configurations, the lower end of the fire-blocking material 1030 can abut at least a portion of the lower leg 1018. The fire-blocking material may be generally contained completely within the interior space. Alternatively, a portion of the fire-blocking material may protrude out of the opening 1022.

The fire-blocking material 1030 can be installed in the interior space through the opening 1022. The inner leg 1012 and/or the lower leg 1018 can flex to open the opening 1022 for installing the fire-blocking material 1030. In another alternative, the fire-blocking material 1030 can be installed at one end of the elongate strip of the gasket 1010 and slid along a length of the gasket 1010.

The return leg 1020 can contact the fire-blocking material 1030 within the interior space. In some configurations, the return leg 1020 can be engaged with or compressed into the fire-blocking material 1030. The return leg 1020 can provide a retention force to prevent or inhibit movement of the fire-blocking material 1030, such as sliding, within the interior space. Alternatively or in addition, an adhesive can be applied to the profile 1011 and/or the fire-blocking material 1030 to prevent movement of the fire-blocking material 1030 within the interior of the profile 1011. The inner leg 1012 and the return leg 1020 can be temporarily flexed outwardly to allow the fire-blocking material 1030 to be installed.

Figure 2:
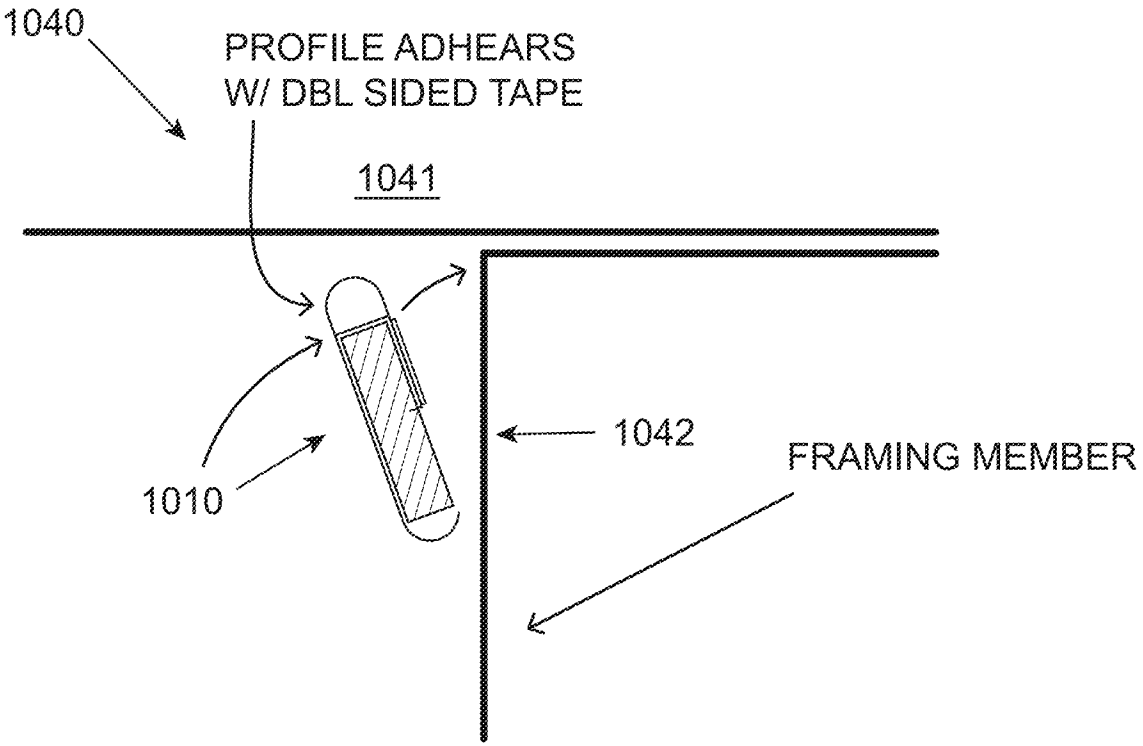
FIG. 2 shows assembly of the fire-blocking gasket with a track.
Figure 3:
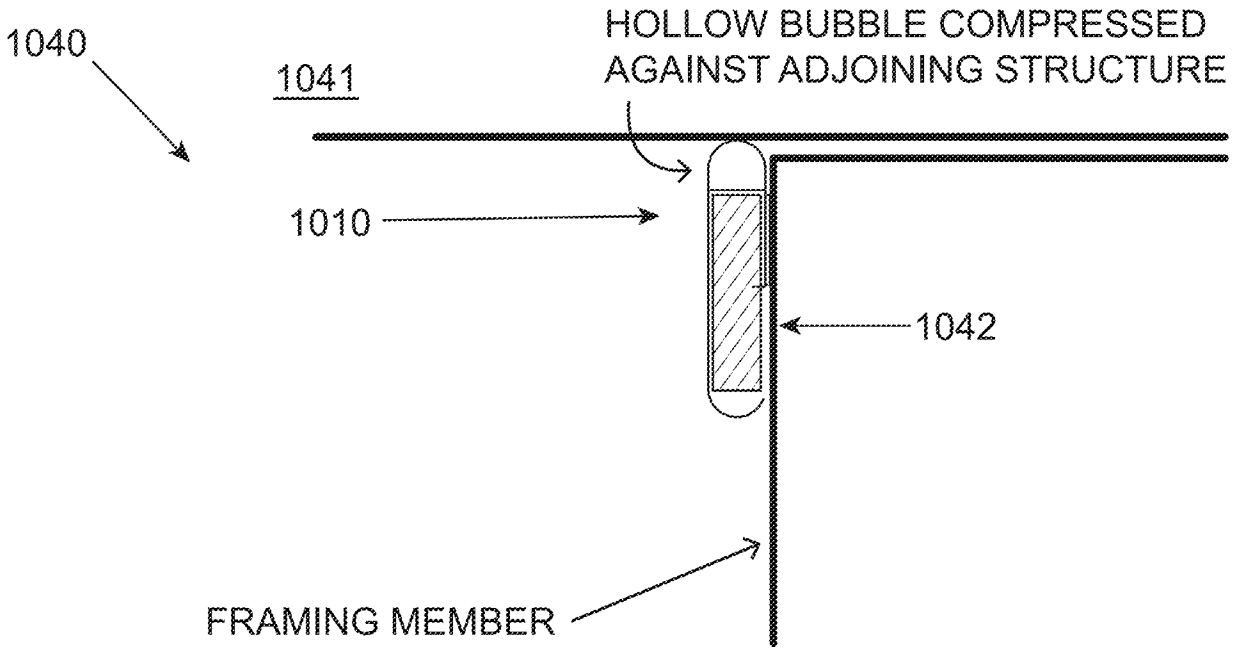
FIG. 3 shows assembly of the fire-blocking gasket with a track.
Figure 4:
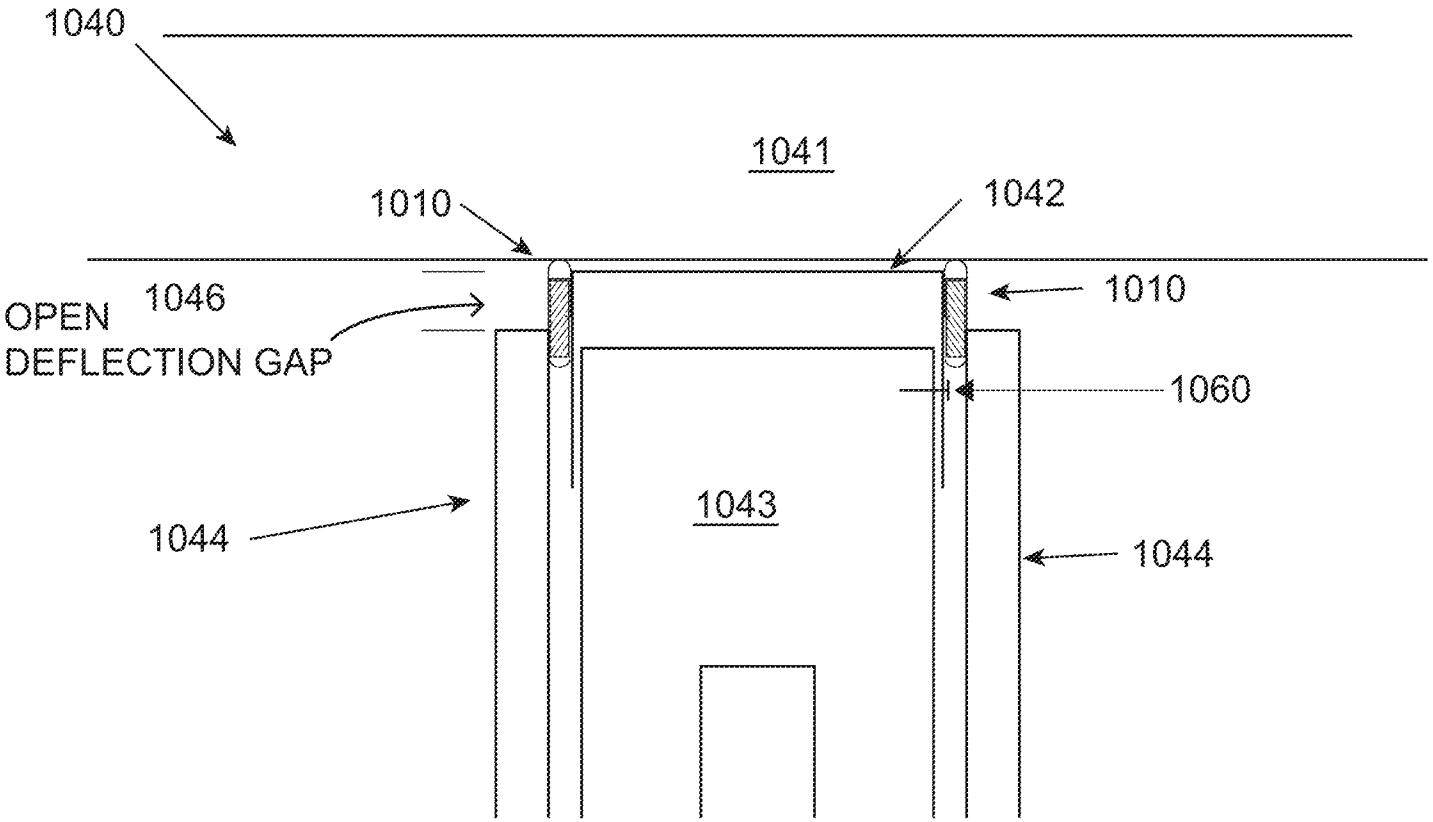
FIG. 4 shows the fire-blocking gasket installed within a dynamic head-of-wall assembly to provide fire-blocking across a deflection gap.

FIGS. 2 and 3 show assembly of the fire-blocking gasket 1010 within a head-of-wall assembly 1040. The head-of-wall assembly 1040 can include a header track 1042 attached to an overhead structure 1041, such as a ceiling or the underside of a deck. The header track 1042 can generally include a pair of flanges extending from a web (one flange shown in FIGS. 2 and 3). Flanges can extend in the same direction to form a U shape with the web. A stud 1043 can be attached between the flanges of the header track and a wall board 1044 can be attached with the studs. The header track 1042 can be a slotted header track so that the ceiling 1041 can move with respect to the wall board 1044 and the stud 1043. A deflection gap 1046 that can be located between the top of the wall board 1044 and the ceiling 1041. The fire-blocking gasket 1010 can be installed within the deflection gap 1046 to provide protection across the deflection gap against fire, smoke, or sound.

The inner leg 1012 of the profile 1011 can be attached with the header track 1042. The inner leg 1012 can be attached with one of the extending flanges. The protective film can be removed from the tape 1024 and attached directly to the side of the header track 1042. The gasket 1010 can be installed before or after the header track 1042 is attached with the overhead structure 1041. Pre-installation of the gasket 1010 with the header track 1042 (e.g., at a factory) can reduce the number of steps required for fire blocking of the head-of-wall assembly 1040. The gasket 1010 can be installed before the wall board 1044 is attached with the studs 1043. The wall board 1044 can overlap at least a portion of the gasket 1010 (in an open or closed configuration of the deflection gap 1046).

In the installed configuration, the upper gasket 1026 can abut the ceiling 1041. The upper gasket 1026 can provide a full or partial seal across the space between the header track 1042 and the ceiling 1041.

In the installed configuration, the opening 1022 can face the header track 1042. Facing the opening 1022 towards the track 1042 can protect the fire-blocking material 1030 and prevent dislodgement or damage thereto. If an intumescent is contained within the fire-blocking material 1030, the profile 1011 can at least partially contain the expansion of the intumescent within the deflection gap 1046 when subjected to sufficient heat. The intumescent can expand primarily out of the opening 1022. This can help the intumescent to provide an effective seal across the deflection gap and prevent unwanted dislodgement of the expanded intumescent from the deflection gap 1046.

The rounded curvature and/or the free end 1019 of the lower leg 1018 can facilitate cycling of the deflection gap 1046 (i.e., movement of the wall board 1044 and stud 1043 relative to the overhead structure 1041 and the header track 1042). The cycling can open and close the deflection gap 1046. The header track 1042 can be attached with the stud 1043 by one or more mechanical fasteners within slotted tracks. The mechanical fasteners can be fixed relative to the moving header track 1042 during cycling of the deflection gap 1046. The rounded or hooked shape of the lower leg

1018 can help avoid hang-ups between the heads of the mechanical fasteners and the gasket 1010. The curvature of the lower leg 1018 allows the heads to pass under the gasket 1010 and prevent dislodging the gasket 1010 from its attachment with the track 1042.

Figure 5:
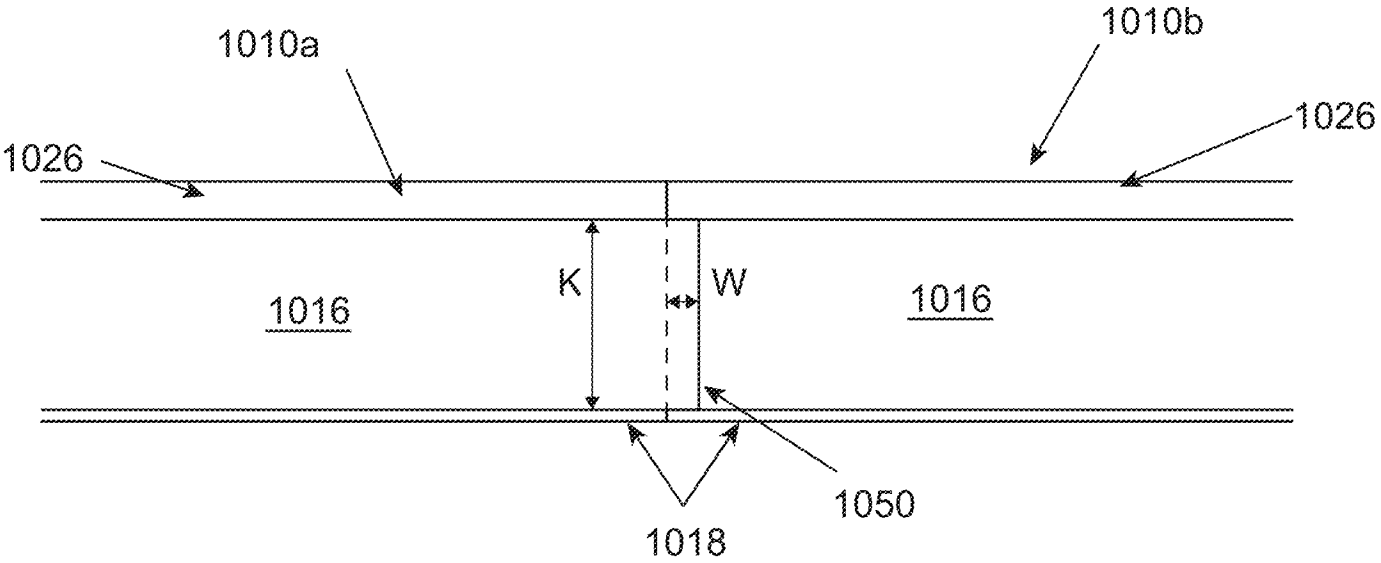
FIG. 5 illustrate an interface between ends of two adjacent fire-blocking gaskets including an overlapping tab.

FIG. 5 shows a plan view of two fire-blocking gaskets 1010*a*, 1010*b*, like the gasket 1010. One end of the gasket 1010*a* can include a tab 1050. The tab 1050 can be an extension of the outer leg 1016. The tab 1050 can be coplanar with the outer leg 1016. The tab 1050 can extend in a length direction of the gasket 1010*a*, as shown in FIG. 5, a width W past the ends of the other components of the profile 1011. The tab 1050 can extend past the upper gasket 1026, the lower leg 1018 and/or any of the other legs of the profile 1011. The tab 1050 can have a height less than or equal to the height K of the outer leg 1016.

Figure 6:
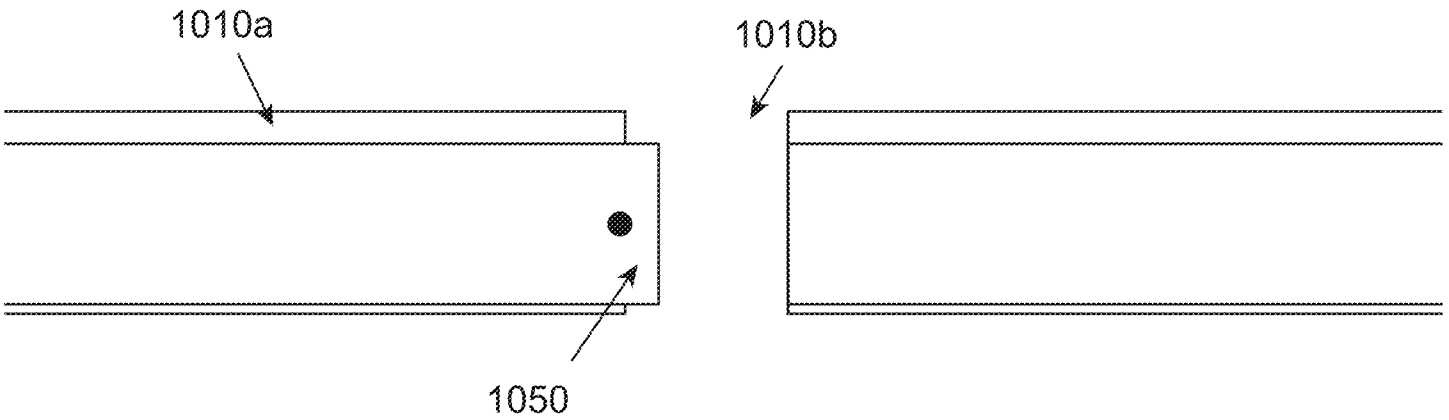
FIG. 6 illustrate an interface between ends of two adjacent fire-blocking gaskets including an overlapping tab.

In an installed configuration shown in FIG. 6, the tab 1050 can overlap with the outer leg 1016 of the second fire-blocking gasket 1010*b* while the ends of the other components of the profiles 1011 abut each other (e.g., the upper gaskets 1026 can abut each other and the lower legs 1018 can abut each other across an interface (i.e., without overlap)). A tape or other attachment can be used to secure the tab 1050 with the gasket 1010*b* (e.g., a double-sided tape on the underside of the tab 1050 or a tape or mechanical fastener over an outer surface of the tab 1050 and the gasket 1010*b*).

Figure 7:
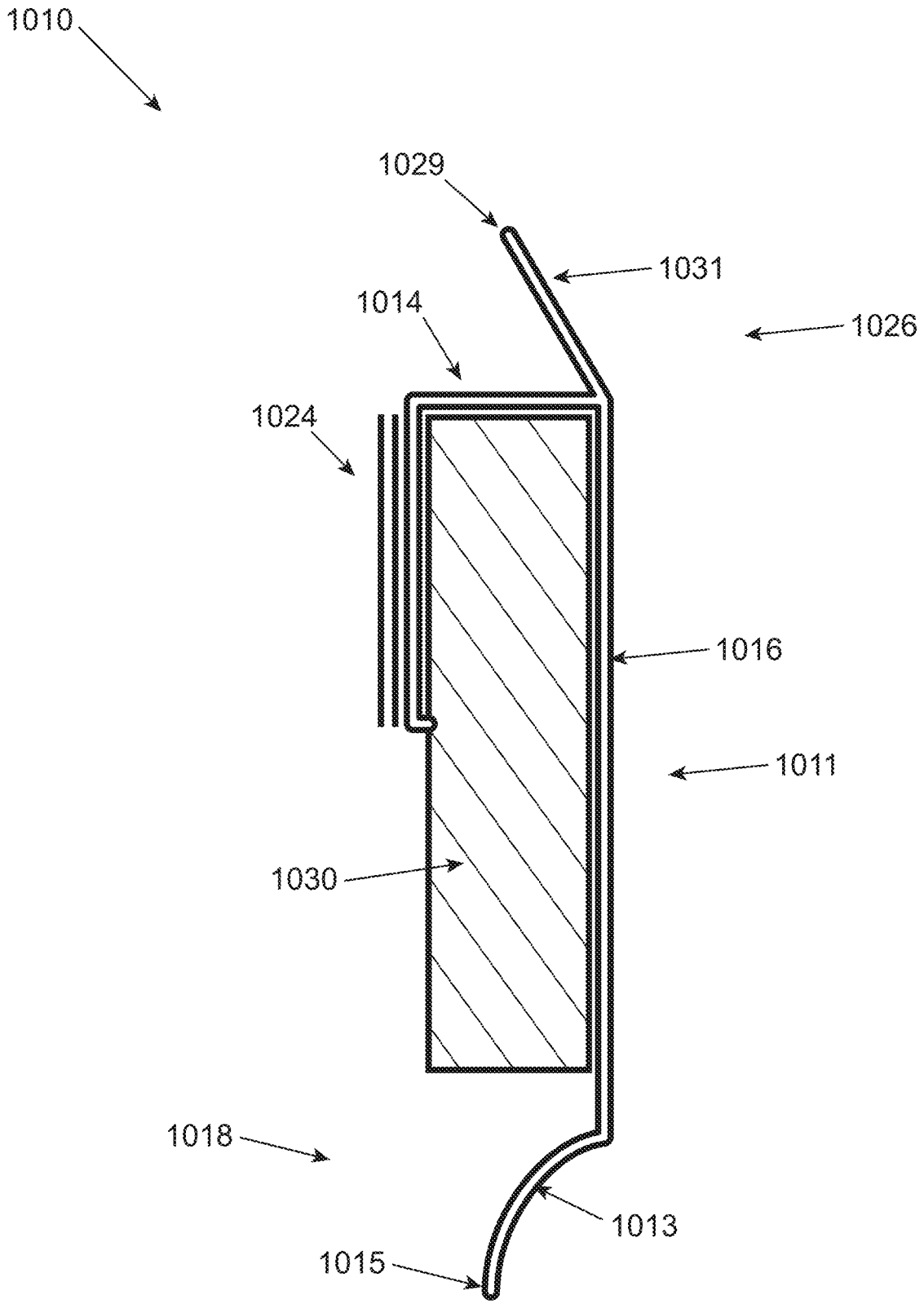
FIG. 7 illustrates an alternative embodiment of fire-blocking gasket including a fire-blocking material within an interior of a casing or profile.
Figure 8:
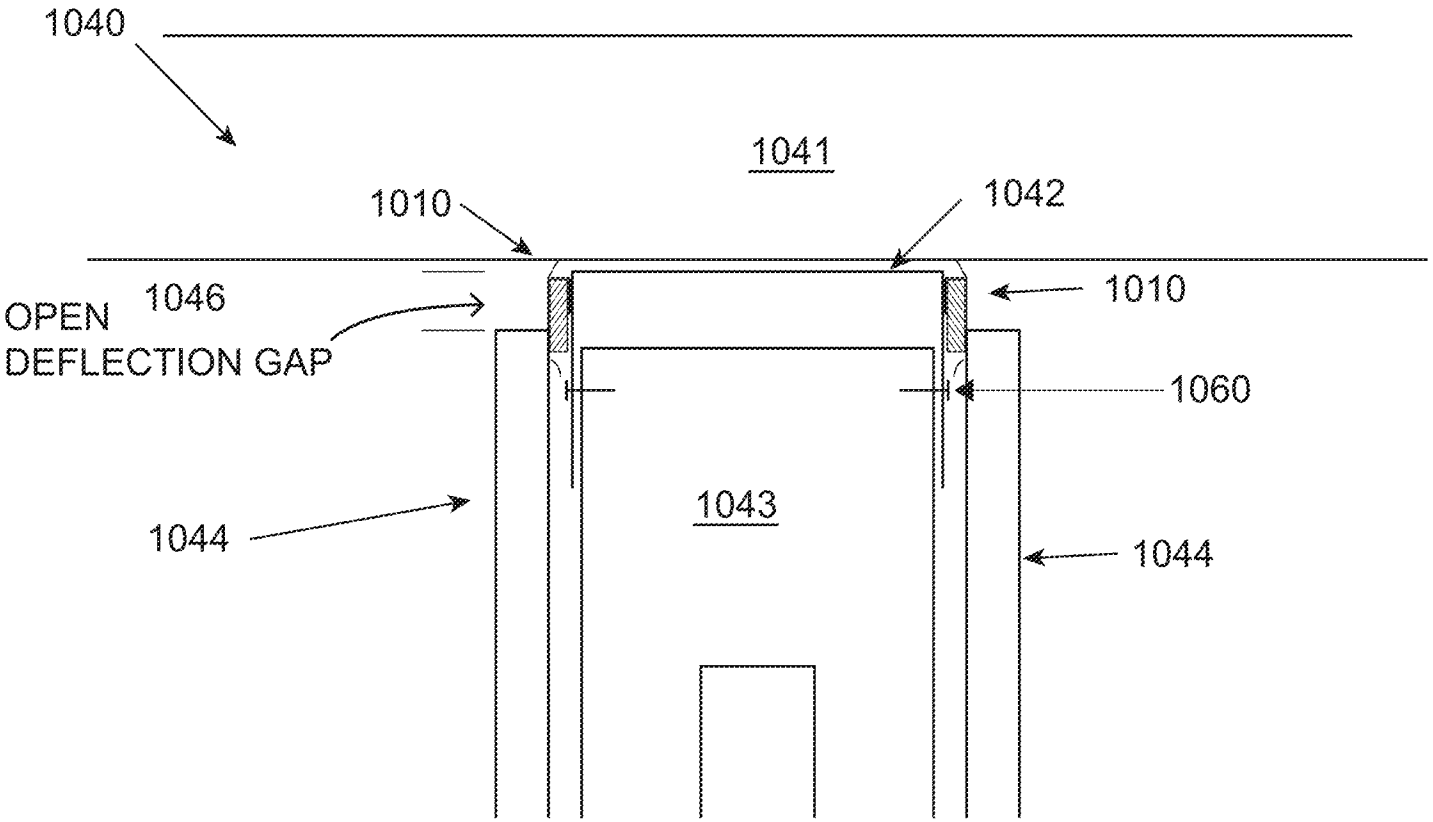
FIG. 8 shows the alternative fire-blocking gasket installed within a dynamic head-of-wall assembly to provide fire-blocking across a deflection gap.

FIG. 7 and FIG. 8 show an alternative embodiment of the fire-blocking gasket 1010. It is understood that the structure and operation of the alternative embodiment shown in FIG. 7 and FIG. 8 can be in some or all respects, apart from what is described herein, identical to the fire-blocking gasket 1010 described above. Thus, the illustrations and operations set forth and described above for the fire-blocking gasket 1010 can also be understood to apply with equal force and effect to the fire-blocking gasket 1010 shown in FIG. 7 and FIG. 8.

Similar to the fire-blocking gasket 1010 shown in FIGS. 1 through 6, the fire-blocking gasket 1010 shown in FIG. 7 and FIG. 8 provides an elongate, fire-rated joint component or fire-blocking gasket which is configured to provide fire protection and pass the relevant UL (or other relevant fire rating) tests or standards. In some embodiments, the fire-blocking gasket 1010 is used in a head-of-wall joint assembly. In some other embodiments, the fire-blocking gasket 1010 could be used in a foot-of-wall joint assembly.

FIG. 7 and FIG. 8 show an alternative embodiment of the fire-blocking gasket 1010 that offers an advantage over other embodiments. For example, the unique features of the alternative embodiment shown in FIG. 7 and FIG. 8 allows the entire profile 1011 to be made from the same material as a single piece. In some embodiments, the profile 1011 can be made from the same vinyl material without co-extrusion. This provides the advantage of creating the profile 1011 at a lower cost while possibly also increasing the speed of production.

FIG. 7 sets forth an end view or sectional view of the fire-blocking gasket 1010 including a fire-blocking material within an interior of a casing or profile 1011. The fire-blocking gasket 1010 of FIG. 7 can be manufactured in various dimensions. Similar to the other embodiment explained and discussed above, it can be manufactured in different lengths such as 4, 5, 8, 10, or 12 feet, or other lengths within a range between any two of these lengths. In other embodiments, it could be made shorter than 4 feet or longer than 12 feet. In some configurations, the height of the fire-blocking gasket 1010 can range between about ¾ inch and 4 inches, or about 1 inch and 4 inches. In some other configurations, the width of the fire-blocking gasket 1010 can be between about ⅛ inch and ½ inch. However, other dimensions outside the aforementioned examples can be used based on the end-user's needs.

The profile 1011 can include or be connected to many segments. For example, the profile 1011 can include an upper gasket 1026 and a lower leg or lower end portion 1018. In some embodiments, the upper gasket 1026 can be a flexible fin, having a flexible leg 1031 with an upper free-end 1029. The flexible fin 1026 can define an interior open space partially surrounded by the flexible leg 1031 and the upper leg 1014 on two sides, but otherwise open. In some configurations when installed in a head-of-wall assembly, the flexible fin 1026 can form a closed interior space surrounded by the upper leg 1014, the flexible leg 1031, the top track 1042, and the overhead structure 1041. In some embodiments, the upper gasket 1026 can be made of the same vinyl material as the rest of profile 1011 without co-extrusion. In some other embodiments, it can be made of rubber, silicone, foam, or other similar materials. Regardless of whether the upper gasket 1026 is made of the same or different material as the rest of the profile 1011, the upper gasket 1026 can be manufactured to have characteristics that will allow it to have more flexibility than the rest of the profile 1011. For example, the upper gasket 1026 can have a different density, thickness, stiffness, etc. than the rest of the profile 1011.

The profile 1011 can include the outer leg 1016, which can be manufactured as part of the same material as the upper gasket 1026. But it can also be made of different materials than the upper gasket 1026. If made of the same material, the entirety of the profile 1011 (including the upper gasket 1026, the outer leg 1016, and the lower leg 1018) can be made as one homogenous material. In some embodiments, the entirety of the profile 1011 can be made of vinyl. In some other embodiments where the upper gasket 1026 and the outer leg 1016 are not manufactured as one piece, the outer leg 1016 connects with the upper leg 1026 using an appropriate attachment arrangement, such as mechanical attachment, adhesive, welding or the like. The flexible leg 1031 and the upper leg 1014 can form an angle between 0 degree to 10 degrees, 10 degrees to 20 degrees, 20 degrees to 30 degrees, 30 degrees to 40 degrees, 40 degrees to 50 degrees, 50 degrees to 60 degrees, 60 degrees to 70 degrees, 70 degrees to 80 degrees, 80 degrees to 90 degrees, or other angles within a range between any two of these angles. In some other embodiments, the angle between the upper leg 1014 and the flexible leg 1031 could be between 90 degrees to 180 degrees, or other angles within the range of 90 degrees to 180 degrees. The flexible leg 1031 can generally be a straight piece without any bent or curvature such as the one shown in FIG. 7. However, other shapes and configurations, such as round, curved, semi-circular shapes, etc. can also be used.

In some embodiments, the lower gasket 1018 can be an open free-end curve. The lower leg 1018 can include a reverse curve leg 1013 and a lower free end 1015. On the interior side facing the header track 1042, the lower leg 1018 forms a closed space surrounded by the reverse curve leg 1013, the fire blocking material 1030, and the header track 1042. The reverse curve leg 1013 can be manufactured as part of the same material as the upper gasket 1026. But it can also be made of different materials than the upper gasket 1029. If made of the same material, the entirety of the profile 1011 (including the upper gasket 1026, the outer leg 1016, and the lower leg 1018) can be made as one homogenous material without the need for co-extrusion. In some embodiments, the entirety of the profile 1011 can be made of vinyl. In some other embodiments where the lower leg 1018 and the outer leg 1016 are not manufactured as one piece, the outer leg 1016 connects with the reverse curve leg 1013 using an appropriate attachment arrangement, such as mechanical attachment, adhesive, welding or the like. The construction of the lower leg 1018 with an open free-end curve, such as the one shown in FIG. 7, provides several advantages. For example, the unique design and flexibility of the lower free end 1015 allows the stud fasteners 1060 to slide behind the profile 1011 during dynamic movement. Similar to the upper gasket 1026, the lower leg 1018 can be manufactured to have characteristics that will allow it to have more flexibility than the rest of the profile 1011. For example, the lower leg 1018 can have a different density, thickness, stiffness etc. than the rest of the profile 1011.

FIG. 8 shows the fire-blocking gasket 1010 of FIG. 7 assembled into a head-of-wall assembly 1040. Similar to the embodiment discussed with respect to FIG. 4, the fire-blocking gasket 1010 can be used to provide adequate fireproofing for the open deflection gap 1046, thus allowing the entire wall assembly to maintain its required fire rating. Similarly, it can be used to prevent passage of smoke, sound, air, or the like. The fire-blocking gasket 1010 can be attached to the header track 1042 with tape 1024, which can be a double-sided tape or other types of adhesive or other mechanisms that can facilitate the attachment. In some configurations, such as the one shown in FIG. 8, the fire-blocking gasket 1010 is between the header track 1042 and the wallboard 1044. While the fire-blocking gasket 1010 can be attached to the header tracker 1042, it does not have to be attached to the wallboard 1044. In a configuration in which the fire-blocking gasket 1010 is not attached to the wallboard 1044, the wallboard 1044 can move up and down during a dynamic movement while the fire-blocking gasket 1010 provides and maintains the required coverage to prohibit fire, smoke, sound, air, etc. from moving from one side of the wall to the other side of the wall.

Certain Terminology

Terms of orientation used herein, such as "top," "bottom," "proximal," "distal," "longitudinal," "lateral," and "end," are used in the context of the illustrated example. However, the present disclosure should not be limited to the illustrated orientation. Indeed, other orientations are possible and are within the scope of this disclosure. Terms relating to circular shapes as used herein, such as diameter or radius, should be understood not to require perfect circular structures, but rather should be applied to any suitable structure with a cross-sectional region that can be measured from side-to-side. Terms relating to shapes generally, such as "circular," "cylindrical," "semi-circular," or "semi-cylindrical" or any related or similar terms, are not required to conform strictly to the mathematical definitions of circles or cylinders or other structures, but can encompass structures that are reasonably close approximations.

Conditional language, such as "can," "could," "might," or "may," unless specifically stated otherwise, or otherwise understood within the context as used, is generally intended to convey that certain examples include or do not include, certain features, elements, and/or steps. Thus, such conditional language is not generally intended to imply that features, elements, and/or steps are in any way required for one or more examples.

Conjunctive language, such as the phrase "at least one of X, Y, and Z," unless specifically stated otherwise, is otherwise understood with the context as used in general to convey that an item, term, etc. may be either X, Y, or Z. Thus, such conjunctive language is not generally intended to imply that certain examples require the presence of at least one of X, at least one of Y, and at least one of Z.

The terms "approximately," "about," and "substantially" as used herein represent an amount close to the stated amount that still performs a desired function or achieves a desired result. For example, in some examples, as the context may dictate, the terms "approximately," "about," and "substantially," may refer to an amount that is within less than or equal to 100% of the stated amount. The term "generally" as used herein represents a value, amount, or characteristic that predominantly includes or tends toward a particular value, amount, or characteristic. As an example, in certain examples, as the context may dictate, the term "generally parallel" can refer to something that departs from exactly parallel by less than or equal to 20 degrees. All ranges are inclusive of endpoints.

Summary

Several illustrative examples of fire-blocking components and joints have been disclosed. Although this disclosure has been described in terms of certain illustrative examples and uses, other examples and other uses, including examples and uses which do not provide all of the features and advantages set forth herein, are also within the scope of this disclosure. Components, elements, features, acts, or steps can be arranged or performed differently than described and components, elements, features, acts, or steps can be combined, merged, added, or left out in various examples. All possible combinations and subcombinations of elements and components described herein are intended to be included in this disclosure. No single feature or group of features is necessary or indispensable.

Certain features that are described in this disclosure in the context of separate implementations can also be implemented in combination in a single implementation. Conversely, various features that are described in the context of a single implementation also can be implemented in multiple implementations separately or in any suitable subcombination. Moreover, although features may be described above as acting in certain combinations, one or more features from a claimed combination can in some cases be excised from the combination, and the combination may be claimed as a subcombination or variation of a subcombination.

Any portion of the steps, processes, structures, and/or devices disclosed or illustrated in one example in this disclosure can be combined or used with (or instead of) any other portion of the steps, processes, structures, and/or devices disclosed or illustrated in a different example or flowchart. The examples described herein are not intended to be discrete and separate from each other. Combinations, variations, and some implementations of the disclosed features are within the scope of this disclosure.

While operations may be depicted in the drawings or described in the specification in a particular order, such operations need not be performed in the particular order shown or in sequential order, or that all operations be performed, to achieve desirable results. Other operations that are not depicted or described can be incorporated in the example methods and processes. For example, one or more additional operations can be performed before, after, simultaneously, or between any of the described operations.

Additionally, the operations may be rearranged or reordered in some implementations. Also, the separation of various components in the implementations described above should not be understood as requiring such separation in all implementations, and it should be understood that the described components and systems can generally be integrated together in a single product or packaged into multiple products. Additionally, some implementations are within the scope of this disclosure.

Further, while illustrative examples have been described, any examples having equivalent elements, modifications, omissions, and/or combinations are also within the scope of this disclosure. Moreover, although certain aspects, advantages, and novel features are described herein, not necessarily all such advantages may be achieved in accordance with any particular example. For example, some examples within the scope of this disclosure achieve one advantage, or a group of advantages, as taught herein without necessarily achieving other advantages taught or suggested herein. Further, some examples may achieve different advantages than those taught or suggested herein.

Some examples have been described in connection with the accompanying drawings. The figures are drawn and/or shown to scale, but such scale should not be limiting, since dimensions and proportions other than what are shown are contemplated and are within the scope of the disclosed invention. Distances, angles, etc. are merely illustrative and do not necessarily bear an exact relationship to actual dimensions and layout of the devices illustrated. Components can be added, removed, and/or rearranged. Further, the disclosure herein of any particular feature, aspect, method, property, characteristic, quality, attribute, element, or the like in connection with various examples can be used in all other examples set forth herein. Additionally, any methods described herein may be practiced using any device suitable for performing the recited steps.

For purposes of summarizing the disclosure, certain aspects, advantages and features of the inventions have been described herein. Not all, or any such advantages are necessarily achieved in accordance with any particular example of the inventions disclosed herein. No aspects of this disclosure are essential or indispensable. In many examples, the devices, systems, and methods may be configured differently than illustrated in the figures or description herein. For example, various functionalities provided by the illustrated modules can be combined, rearranged, added, or deleted. In some implementations, additional or different processors or modules may perform some or all of the functionalities described with reference to the examples described and illustrated in the figures. Many implementation variations are possible. Any of the features, structures, steps, or processes disclosed in this specification can be included in any example.

In summary, various examples of fire-blocking components and joints and related methods have been disclosed. This disclosure extends beyond the specifically disclosed examples to other alternative examples and/or other uses of the examples, as well as to certain modifications and equivalents thereof. Moreover, this disclosure expressly contemplates that various features and aspects of the disclosed examples can be combined with, or substituted for, one another. Accordingly, the scope of this disclosure should not be limited by the particular disclosed examples described above, but should be determined only by a fair reading of the Claim.

What is claimed is:

1. A fire-rated head-of-wall assembly that allows dynamic movement, comprising:

a header track coupled to an overhead structure, the header track having a web and first and second flanges extending from the web in the same direction away from the overhead structure, wherein each of the first and second flanges is substantially planar such that the header track defines a substantially U-shaped cross section;

a stud coupled with the header track, an upper end of the stud located between the first and second flanges;

a wall board coupled to the stud;

a deflection gap formed between an upper end of the wall board and the overhead structure, the deflection gap being variable between a closed position and an open position as a result of movement of the wall board and the overhead structure relative to one another;

a gasket connected to the header track for fire-blocking the deflection gap, comprising:

a profile, comprising:

an inner leg having a lower end that defines a lowermost extent of the inner leg;

an outer leg;

an upper leg connecting the inner leg and the outer leg;

a lower leg connected to the outer leg;

an interior at least partially enclosed by the inner leg, the outer leg, the upper leg, and the lower leg; and an opening into the interior defined between the lower end of the inner leg and the lower leg;

an upper gasket extending from the upper leg; and a fire-blocking material strip disposed within the interior of the profile;

wherein the gasket is connected at the inner leg to the first flange of the header track, the upper gasket contacts the overhead structure, and the wall board at least partially overlaps the outer leg in the open position and the closed position of the deflection gap.

2. The fire-rated head-of-wall assembly of claim 1, wherein the gasket has a height direction that extends between the upper leg and the lower leg and a length direction that extends along the outer leg and is perpendicular to the height direction and to a thickness of the outer leg of the profile, wherein a first end of the gasket further comprises a tab member that extends in the length direction of the gasket beyond the profile and is configured to overlap a second gasket.

3. The fire-rated head-of-wall assembly of claim 2, wherein the outer leg comprises the tab member, the tab member extending past ends of the upper gasket, the upper leg, the inner leg, and the lower leg in the length direction of the gasket.

4. The fire-rated head-of-wall assembly of claim 3, wherein the tab member has a length of at least ½ inch.

5. The fire-rated head-of-wall assembly of claim 1, wherein the profile comprises a vinyl material.

6. The fire-rated head-of-wall assembly of claim 1, wherein upper gasket is formed integrally with the upper leg of a first material.

7. The fire-rated head-of-wall assembly of claim 1, wherein the profile comprises a first material, the upper gasket comprises a second, different material, and the upper gasket is co-extruded with the profile.

8. The fire-rated head-of-wall assembly of claim 1, wherein the upper gasket is a bubble gasket having a first side wall aligned with the outer leg and a second side wall aligned with the inner leg such that a width of the bubble gasket is equal to a width of the profile.

9. The fire-rated head-of-wall assembly of claim 1, wherein the upper gasket is a flexible fin having a first end connected to the profile and a second free end, wherein the second free end is located between a first plane defined by the inner leg and a second plane defined by the outer leg.

10. The fire-rated head-of-wall assembly of claim 1, wherein the upper gasket comprises a foam material.

11. The fire-rated head-of-wall assembly of claim 1, further comprising a return leg connected to the inner leg of the gasket, the return leg extending in a direction perpendicular to the inner leg, into the interior and contacting the fire-blocking material strip to inhibit sliding of the fire-blocking material strip within the interior.

12. The fire-rated head-of-wall assembly of claim 1, further comprising an adhesive within the interior to inhibit sliding of the fire-blocking material strip within the interior.

13. The fire-rated head-of-wall assembly of claim 1, further comprising a double sided tape attaching the gasket with the header track, the double sided tape having a first face attached with the inner leg and a second face attached with the first flange.

14. The fire-rated head-of-wall assembly of claim 1, further comprising an opening into the interior extending between the inner leg and the lower leg of the gasket;

wherein at least a portion of the fire-blocking material strip aligns with the opening and the opening is at least partially aligned with the first flange of the header track.

15. The fire-rated head-of-wall assembly of claim 1, wherein the fire-blocking material strip comprises an intumescent material.

16. The fire-rated head-of-wall assembly of claim 1, wherein the fire-blocking material strip comprises a mineral wool.

17. The fire-rated head-of-wall assembly of claim 1, wherein the fire-blocking material strip comprises at least one layer of mineral wool and at least one layer of graphite.

18. The fire-rated head-of-wall assembly of claim 1, wherein the lower leg defines an outwardly curved shape relative to the interior of the profile that is configured to allow the lower leg to pass over a mechanical fastener attaching the header track to the stud, wherein the outwardly curved shape of the lower leg defines a lowermost extent of the gasket and the free end is located closer to the upper leg than the lowermost extent, and the free end of the lower leg contacts the first flange.

19. The fire-rated head-of-wall assembly of claim 1, wherein the upper gasket is a bubble gasket having a first side wall that originates at an upper end of the outer leg and a second side wall that originates at an upper end of the inner leg.

20. The fire-rated head-of-wall assembly of claim 1, wherein the fire-blocking material strip comprises a first layer and a second layer.

21. The fire-rated head-of-wall assembly of claim 1, wherein the gasket is coupled to the first flange of the header track only along the inner leg.

22. The fire-rated head-of-wall assembly of claim 1, wherein the lower leg defines an inwardly curved shape relative to the interior of the profile, the inwardly curved shape having a free end that defines a lowermost extent of the gasket, wherein the free end of the rounded lower leg is configured to be spaced outwardly from the first flange of the header track to allow the lower leg to pass over a mechanical fastener attaching the header track to the stud.

23. A gasket for fire-blocking a dynamic deflection gap, comprising:

a profile, comprising:

an inner leg having a lower end that defines a lowermost extent of the inner leg;

an outer leg;

an upper leg connecting an upper end of the inner leg and an upper end of the outer leg;

a lower leg connected to a lower end of the outer leg; and an interior at least partially enclosed by the inner leg, the outer leg, the upper leg, and the lower leg;

wherein the lower leg is spaced below the lower end of the inner leg such that an opening to the interior is defined between the inner leg and the lower leg;

an upper gasket extending from the upper leg;

a fire-blocking material strip disposed within the interior of the profile; and an adhesive layer attached to the inner leg and configured to attach the gasket to a track of a wall assembly.

24. A fire-rated head-of-wall assembly that allows dynamic movement, comprising:

a header track coupled to an overhead structure, the header track having a web and first and second flanges extending from the web in the same direction away from the overhead structure, wherein each of the first and second flanges is substantially planar such that the header track defines a substantially U-shaped cross section;

a stud coupled to the header track, an upper end of the stud located between the first and second flanges;

a wall board coupled to the stud;

a deflection gap formed between an upper end of the wall board and the overhead structure, the deflection gap being variable between a closed position and an open position as a result of movement of the wall board and the overhead structure relative to one another;

a gasket for fire-blocking the deflection gap, comprising:

a profile, comprising:

an inner leg;

an outer leg;

an upper leg connecting the inner leg and the outer leg;

a lower leg connected to the outer leg;

an interior at least partially enclosed by the inner leg, the outer leg, the upper leg, and the lower leg; and an upper gasket extending from the upper leg; and a fire-blocking material strip disposed within the interior of the profile;

wherein the gasket is coupled to the first flange of the header track along the inner leg, the upper gasket contacts the overhead structure, and the wall board at least partially overlaps the outer leg in the open position and the closed position of the deflection gap;

wherein the lower leg includes a free end having a hook shape extending inwardly from the outer leg, the hook shape configured to allow the lower leg to pass over a mechanical fastener attaching the header track to the stud, wherein a curved portion of the hook shape defines a lowermost extent of the gasket, and the free end of the lower leg contacts the first flange.

* * * * *